US008777446B2

(12) United States Patent
Sharrah et al.

(10) Patent No.: US 8,777,446 B2
(45) Date of Patent: Jul. 15, 2014

(54) PORTABLE LIGHT HAVING A ROTATABLE HEAD

(75) Inventors: Raymond L. Sharrah, Collegeville, PA (US); Donald J. Keeley, Emmaus, PA (US); Matthew B. Dalton, Elkins Park, PA (US)

(73) Assignee: Streamlight, Inc., Eagleville, PA (US)

( * ) Notice: Subject to any disclaimer, the term of this patent is extended or adjusted under 35 U.S.C. 154(b) by 119 days.

(21) Appl. No.: 13/023,010

(22) Filed: Feb. 8, 2011

(65) Prior Publication Data

US 2012/0033415 A1 Feb. 9, 2012

Related U.S. Application Data

(60) Provisional application No. 61/302,815, filed on Feb. 9, 2010.

(51) Int. Cl.
*F21L 4/04* (2006.01)

(52) U.S. Cl.
USPC ..... 362/199; 362/396; 362/197; 362/255; 362/202

(58) Field of Classification Search
USPC ..... 362/39, 40, 159, 171–178, 81, 362/212–213, 268–289, 217, 372, 374–375, 362/387, 391, 396, 410–411, 362/217.01–217.17, 232–233, 362/249.01–249.19, 249.1, 249.11–249.13, 362/418–430, 167, 168, 188–208, 415, 183, 362/162, 181, 219–225, 311.01, 311.02, 362/352–353, 645–659, 433–434, 312, 367, 362/234–240, 184, 581, 253, 365, 362, 23, 362/319, 450, 523, 109, 800, 640, 555, 557, 362/543–545, 27, 157
See application file for complete search history.

(56) References Cited

U.S. PATENT DOCUMENTS 4,039,821 A * 8/1977 Greene et al. ..... 362/217.08
4,644,456 A * 2/1987 Lydell ..... 362/376

(Continued)

OTHER PUBLICATIONS

Pelican Products, "Big Ed 3700 Photoluminescent Flashlight", http://www.pelican.com/lights_detail_print.php?recordID=3700PL, printed Jul. 22, 2010, 1 page.

(Continued)

*Primary Examiner* — Anh Mai
*Assistant Examiner* — Fatima Farokhrooz
(74) *Attorney, Agent, or Firm* — Clement A. Berard, Esq.; Dann, Dorfman, Herrell & Skillman, PC

(57) ABSTRACT

A portable light may comprise a light body and a light head rotatable relative to the light body. The light head may comprise a light source that may be pivotable relative to a base of the light head. The light source may be electrically connected to the light body by rotatable coaxial connections between the light head and the light body and by rotatable coaxial electrical connections between the base of the light head and the light source. The light may optionally further comprise a hanger movable relative to the light body, or may comprise one or more magnets on the light body, or may comprise a clip on the light body, or a combination thereof.

32 Claims, 15 Drawing Sheets

(56) References Cited

U.S. PATENT DOCUMENTS

| | | | | |
|---|---|---|---|---|
| 5,163,751 | A * | 11/1992 | Bottiglieri | 362/376 |
| D335,715 | S | 5/1993 | Wan | |
| 5,410,237 | A | 4/1995 | Sharrah et al. | |
| D373,211 | S | 8/1996 | Heun | |
| D375,570 | S | 11/1996 | Hayakawa et al. | |
| D378,434 | S | 3/1997 | Petterson et al. | |
| 5,833,358 | A * | 11/1998 | Patik | 362/391 |
| 5,871,272 | A | 2/1999 | Sharrah et al. | |
| D409,777 | S | 5/1999 | Sharrah et al. | |
| D410,557 | S | 6/1999 | Petterson et al. | |
| 5,988,828 | A * | 11/1999 | Prince et al. | 362/191 |
| 6,012,824 | A | 1/2000 | Sharrah et al. | |
| 6,224,230 | B1 * | 5/2001 | Roegiers | 362/123 |
| 6,250,771 | B1 | 6/2001 | Sharrah et al. | |
| 6,350,040 | B1 | 2/2002 | Parker | |
| 6,523,972 | B2 | 2/2003 | Sharrah et al. | |
| 6,585,400 | B2 | 7/2003 | Leen | |
| 6,633,152 | B2 | 10/2003 | Sharrah et al. | |
| 6,659,621 | B2 | 12/2003 | Sharrah et al. | |
| 6,817,730 | B2 | 11/2004 | Sharrah et al. | |
| 7,159,998 | B2 * | 1/2007 | Moreland | 362/249.01 |
| D536,464 | S | 2/2007 | Kingston et al. | |
| 7,172,310 | B2 | 2/2007 | Hsu | |
| D552,279 | S | 10/2007 | Osiecki et al. | |
| D552,280 | S | 10/2007 | Osiecki et al. | |
| 7,314,286 | B2 | 1/2008 | Sharrah et al. | |
| 7,338,189 | B2 | 3/2008 | Kovacik et al. | |
| D590,971 | S | 4/2009 | Spartano et al. | |
| D599,925 | S | 9/2009 | Kingston | |
| D599,926 | S | 9/2009 | Schoch | |
| D605,795 | S | 12/2009 | Baker et al. | |
| 7,646,973 | B2 | 1/2010 | Howard et al. | |
| 7,699,491 | B2 | 4/2010 | Sharrah et al. | |
| 7,850,330 | B2 | 12/2010 | Spartano | |
| 2003/0151914 | A1 | 8/2003 | Kish et al. | |
| 2005/0265035 | A1 * | 12/2005 | Brass et al. | 362/451 |
| 2009/0290335 | A1 | 11/2009 | Levine | |

OTHER PUBLICATIONS

Getflashlights.com, "Energizer-Eveready Flashlights", http://www.getflashlights.com/energizer_eveready . . . , printed May 20, 2010, 5 pages.

Streamlight, Inc., "Survivor Series", www.streamlight.com, © 2010, 4 pages.

Patent Cooperation Treaty, "Notification of Transmittal of the International Search Report and the Written Opinion of the International Searching Authority", May 12, 2011, 11 pages.

LED-WorkLight, "Ultimate Technician's Work Light", 2 pages, © 2010.

Aqua-Air Industries, "Picture of LaserFlex™ 2D", prior to Feb. 8, 2011, 1 page.

Rayovac, "2AA Industrial Swivel Light with Heavy Duty Batteries", printed Feb. 8, 2011, 1 page.

Rayovac, "Black & Decker Lights", including "2AA Swivel Head Work Light", "2AA Work Light", "2D Swivel Head Work Light", "Flex360 LED Clamp Light", "LED Clip Flashlight", and "LED Pocket Flex Light", www.rayovac.com/en/products/lights . . . , printed Feb. 8, 2011, 8 pages.

Rayovac, "Sportsman 2AA Swivel-Lite pictures", object prior to Feb. 8, 2011 (photos taken Jun. 2011), 6 pages.

Rayovac, "Rayovac light pictures", object prior to Feb. 8, 2011 (photos taken Jun. 2011), 4 pages.

Rayovac, "Swivel-Lite pictures", ca. 1996 (photos taken Jun. 2011), 4 pages.

Maxxeon, "WorkStar 1400 light pictures", object prior to Feb. 8, 2011 (photos taken Jun. 2011), 3 pages.

ADARO Tecnologia, SA, "Adalit L2000" web page and pages from brochure, www.adalit.es/EN/HAdalitL2000EN.html, Publicacion No. EP-DA-8/1, Emision: Agosto/ 06. Rev.0, printed Apr. 18, 2011, 2 pages.

Adaro Tecnologia, SA, " Adalit L2000-L/LB Safety Rechargeable Torch User Instructions", Publicacion No. EP-DA-8/3, Emision: Enero 08. Rev.3, date: Jul. 24, 2006, 16 pages.

* cited by examiner

PORTABLE LIGHT HAVING A ROTATABLE HEAD

This Application claims the benefit of U.S. Provisional Patent Application Ser. No. 61/302,815 filed Feb. 9, 2010, entitled "PORTABLE LIGHT HAVING A ROTATABLE HEAD," of U.S. patent application Ser. No. 29/355,530 filed Feb. 9, 2010, entitled "PORTABLE LIGHT HAVING A ROTATABLE HEAD" and of U.S. patent application Ser. No. 29/366,461 filed Jul. 26, 2010, entitled "PORTABLE LIGHT HAVING A ROTATABLE HEAD," each of which is hereby incorporated herein by reference in its entirety.

The present invention relates to a portable light and, in particular, to a portable light having a certain movable parts.

Portable lights, such as flashlights and other lights, are widely used in many government, professional, business, industrial, sporting, and recreation endeavors and different features may be of greater or lesser importance in various ones of such different areas of use. Many portable lights seem to have features directed to a limited range of uses, while a user might prefer a light with more flexible usability.

Among some excellent lights presently available is the SURVIVOR® light available from Streamlight, Inc. of Eagleville, Pa., for example, is a "professional light" that is intended for use in rugged conditions, such as those that may be encountered by firefighters, police, other law enforcement personnel, industrial environments, and the like. The SURVIVOR® light has a spring loaded clip and attachment ring and has a head fixed in position relative to its body. The SYCLONE® light available from Streamlight, Inc. has a rotating clip by which it may be hung from a belt or strap, and has a light-producing head that is articulated relative to its body. The LITEBOX® light also available from Streamlight, Inc. has a light producing head that is pivotable relative to its body.

In particular, certain users may prefer a light that can be attached or mounted to various objects while other users may prefer a light where the light produced thereby may be directed in a desired direction. Other users may desired hands-free operation and/or a light that can be mounted to a body part, e.g., the head or a hat or helmet. Yet others may desire a light that can stand on a horizontal surface. Heretofore, no portable light is known to have been available that addresses such varied desires.

In addition, lights intended for many of such areas of use should be robust and durable so as to better withstand the rigors and usual hazards of certain use environments.

Accordingly, there is a need for a portable light that offers a great deal of flexibility to assist users in different circumstances, e.g., a multi-purpose light. It would also be desirable that such light be durable and robust.

To this end, a portable light may comprise a light body and a light head rotatable relative to the light body.

The light head may comprise a light source that may be pivotable relative to a base of the light head.

The light source may be electrically connected to the light body by rotatable coaxial connections between the light head and the light body and by rotatable coaxial electrical connections between the base of the light head and the light source.

The light may comprise a hanger movable relative to the light body, or may comprise one or more magnets on the light body, or may comprise a hanger movable relative to the light body and one or more magnets on the light body. The hanger may be movable in a track of the light body.

The light body and light head may be connected together at a rotatable connection by a split retainer having projections and/or recesses corresponding to complementary recesses and/or projections on the light body.

BRIEF DESCRIPTION OF THE DRAWING

The detailed description of the preferred embodiment(s) will be more easily and better understood when read in conjunction with the FIGURES of the Drawing which include.

Figure 1:
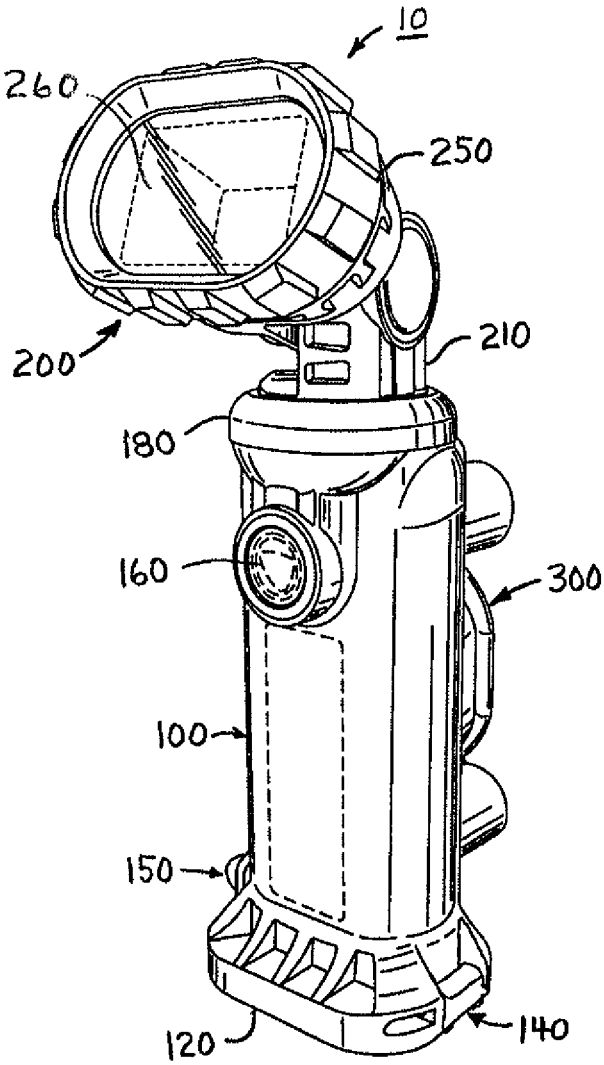
FIG. 1 is a perspective view of an example embodiment of a portable light.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

A portable light of the present arrangement preferably has a light head that is movable over a wide range of positions with respect to a light body thereof, and/or preferably is mountable on various objects in different manners. In a first aspect, preferably the light head is rotatable about a first axis that passes through the light body and is rotatable about a second axis that is substantially orthogonal to the first axis. In another aspect, preferably, the portable light is hangable from or hookable to or clipable to a variety of objects and/or is magnetically attachable to a metal object, thereby to allow hands-free use if desired. Such portable light may preferably be made of one or more substantial plastic materials and/or of other durable and robust materials. Other features may be provided as set forth in the following description.

Figure 2:
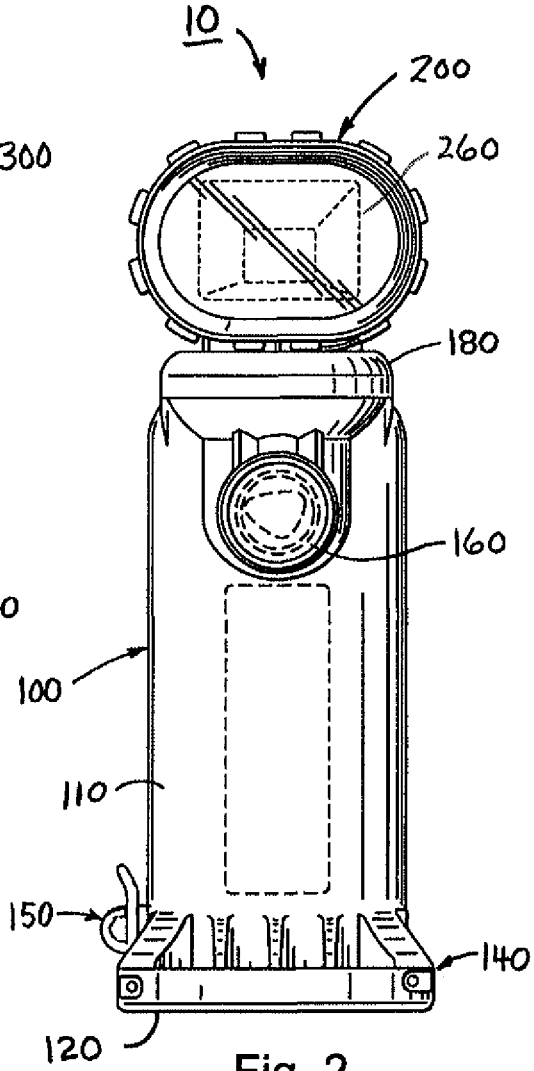
FIG. 2 is a front view of the example portable light.
Figure 3:
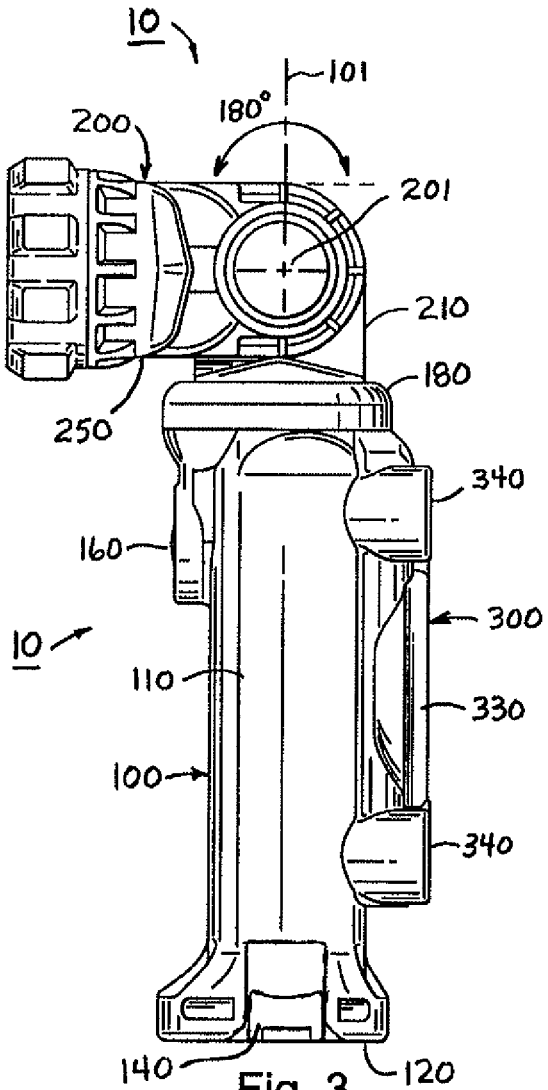
FIG. 3 is a side view of the example portable light.
Figure 4:
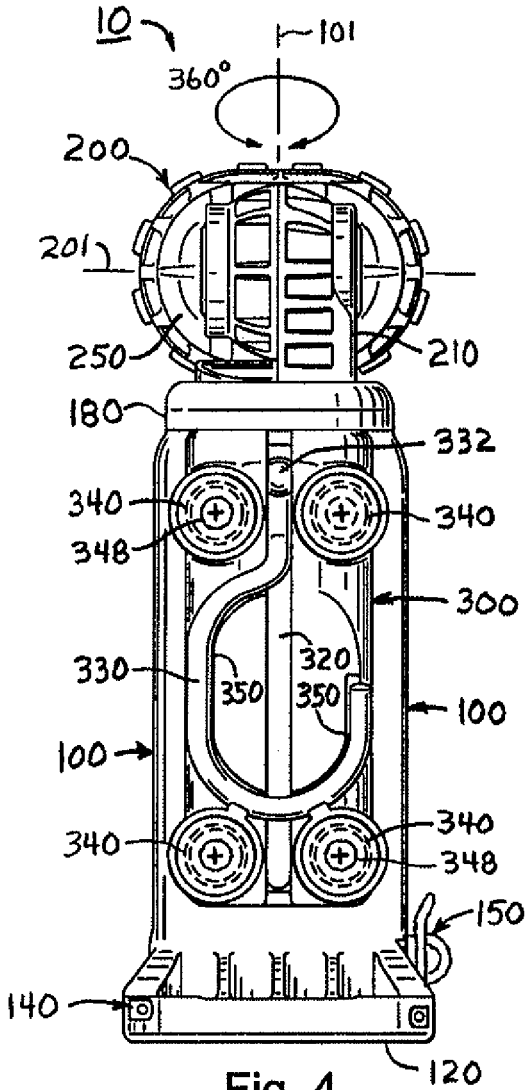
FIG. 4 is a rear view of the example portable light.

An example embodiment of a portable light 10 is described in relation to the perspective view of FIG. 1, the front view of FIG. 2, the side view of FIG. 3, and the rear view of FIG. 4. Portable light 10 comprises a light body 100 to which a head assembly 200 is rotatable mounted, being rotatably retained thereon by retainer ring 180. Light body 100 comprises a housing 110 which has an internal cavity for receiving a battery or other source of electrical power therein. Access to the cavity of housing 110, e.g., for inserting or removing a battery or other electrical power source, may be via a cover 130 in base 120 that is openable by releasing latch 150 and moving cover 130 about hinge 140. Switch 160 on body 110 actuates an electrical switch that controls the application and removal of electrical power from light source 250 and may also control the manner in which such power is applied, e.g., for dimming and un-dimming, for flashing, strobing, and different brightness settings, for momentary ON and continuous ON, operating conditions.

Head assembly 200 is preferably fully rotatable about the central axis 101 of light body 100, i.e. at least 360° of rotation, and electrical contacts which are described below provide electrical conduction paths between light body 100 and head assembly 200. While electrical connections between light body 100 and light head 200 may allow 360° of rotation, it is preferred that electrical contacts that provide unrestricted rotation be employed.

Head assembly 200, alternatively referred to as light head 200, comprises a pivot base 210 that is rotatably mounted to light body 100, preferably for at least the full 360° of rotation. Light head 200 further comprises a light source 250 that is pivotably (rotatably) mounted to pivot base 210 and that preferably is pivotable (rotatable) about axis 201 by about 180° relative to pivot base 210. Preferably the pivotable mounting of light source 250 to pivot base 210 may preferably provide at least 180° of pivoting (rotation), however, it may provide greater or lesser angular pivoting (rotation) depending upon the external shapes of pivot base 210 and light source 250. For example, where pivot base 210 is taller, then angular pivoting (rotation) greater than 180° may be provided.

As a result of the cooperation of the rotatable mounting of light head 200 to light body 100 and the pivotable (rotatable) mounting of light source 250 to pivot base 210, light source 250 is freely positionable using a combination of rotation and pivoting to any position within at least about a complete hemisphere with respect to light body 100. This arrangement provides an advantage to a user who may mount the light 10 to an object and then have great freedom in directing the light produced by light source 250 in a desired direction.

Hanger housing assembly 300 includes a housing or member 310 that attaches to light body 100 and that includes various arrangements for attaching light 10 to an object. For example, housing member 310 may define a track 320 or slot 320 in which a hanger 330 may be engaged. Track 320 presents externally as an elongated slot 320 that is narrower than is track 320 internal to housing member 310 so that hanger 330 is engaged to light body 100 by an enlarged end 332 of hanger 330 that is captive in track 320. Hanger 330 is preferably free to be moved to a desired position along the length of track 320, as well as being moved angularly relative to housing 310 and being rotated relative to housing member 310. As a result, portable light 10 may be attached or hung from other objects in a different positions, thereby to be convenient for a user to aim the light from light source 250 in a desired direction.

Track 320 may be of a size and shape to provide a desired degree of resistance to the movement of enlarged end 332 of hanger 330 therein. In a presently preferred example, enlarged end 332 is spherical and is only slightly smaller in diameter than is track 320 so as to allow hanger 330 to freely move in track 320 from end to end and angularly, whereby light 10 tends to either hang in an orientation with either head assembly being generally up or base 120 being generally up. The fit between track 320 and hanger 330 may be made tighter so that hanger 330 does not so easily move in track 320 or may be made looser so that hanger 330 moves more freely therein.

Also preferably, housing member 310 is shaped to define an external groove or other recess 350 into which hanger 330 may be placed, e.g., for storage. To facilitate such storage, hanger 330 preferably is shaped to have an offset proximate the enlarged end 332 thereof that rides in track 320, thereby to be able to be placed in a storage position against housing member 310. Storage groove 350 of housing 310 is preferably shaped so that hanger 330 bears against one or more sides or edges of groove 350, e.g., by a lip or ridge or other feature, thereby to be retained in groove 350 on the back of light 10 with sufficient force that it will not fall out, but not so much force that it cannot easily be removed for use by a user of light 10.

Housing member 310 also preferably includes one or more magnets 340 by which portable light may be attached to a ferromagnetic object, e.g., a vehicle, structure or any other object, such as a steel object. For example, four magnets 340 may be provided as illustrated so as to provide spaced apart locations of magnetic attachment to the metal object which tends to provide for a more stable mounting thereon. Where the object shape is not generally flat, light 10 may be attached by less than all of the provided magnets 340.

Magnets 340 may be utilized to attach portable light 10 to a vertical surface or to a horizontal surface or to a surface in any other orientation, and light 10 may be attached with light body 100 generally vertical or horizontal or any other orientation, thereby to provide flexibility for a user to orient light 10 and position light source 200 thereof relative to light body 100 so that light can be directed as a user desires. It is noted that when hanger 330 is stored in recess 350, it is preferably recessed, e.g., is closer to light body housing 110 than is the plane defined by the magnets 340, thereby to not interfere with magnetically attaching light 10 to an object.

Figure 5:
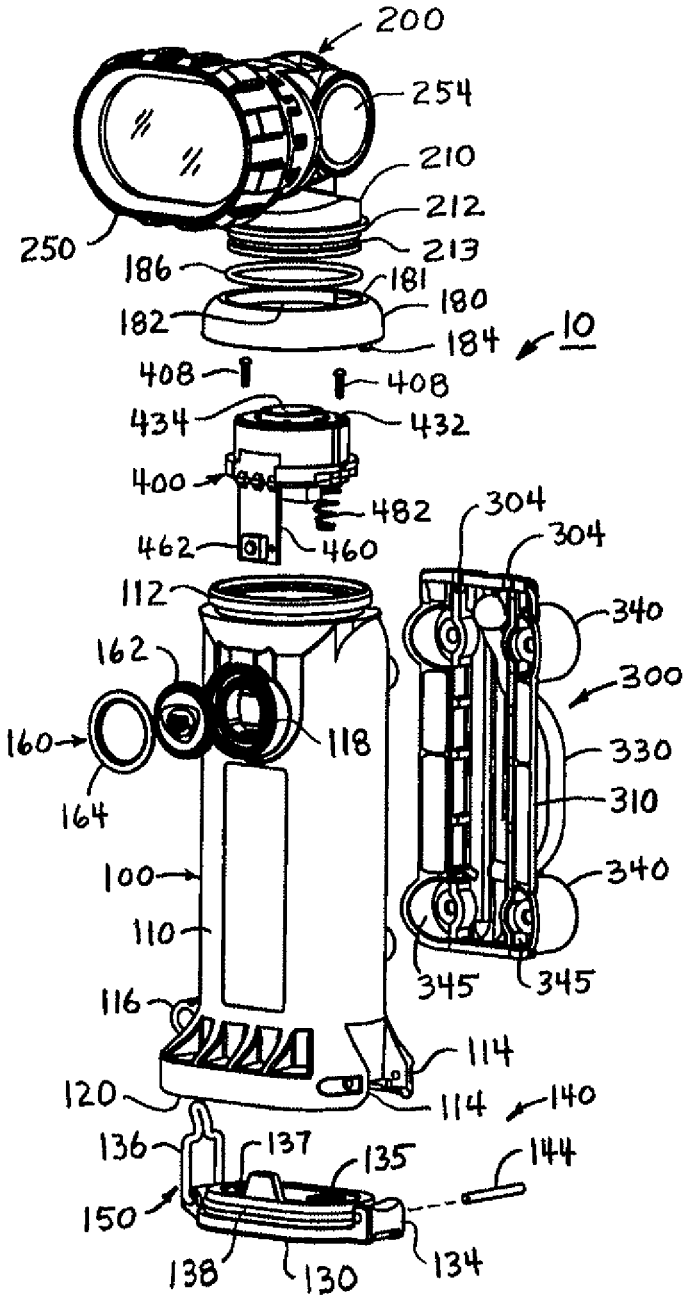
FIG. 5 is an exploded view of the example portable light.
Figure 6B:
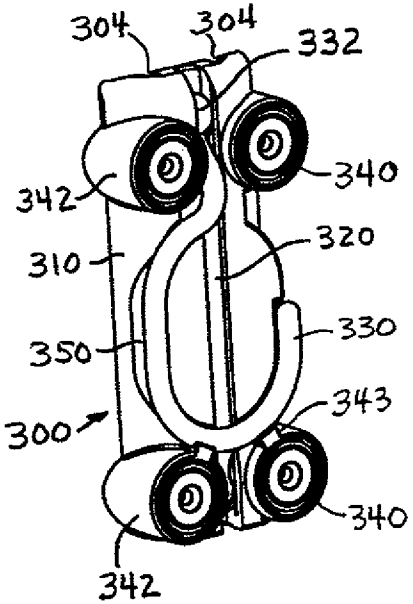
FIGS. 6A and 6B are an exploded view of the rear side of the example light body and a perspective view of an example hanger housing assembly, respectively.
Figure 6A:
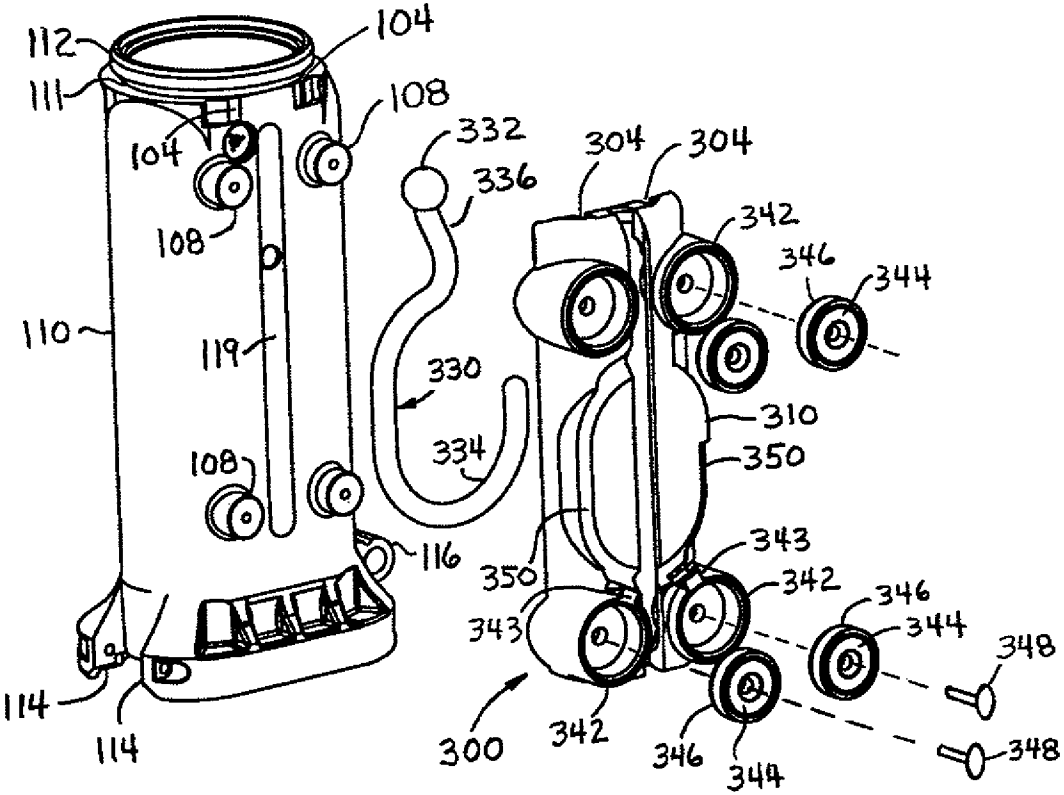
Figure 8B:
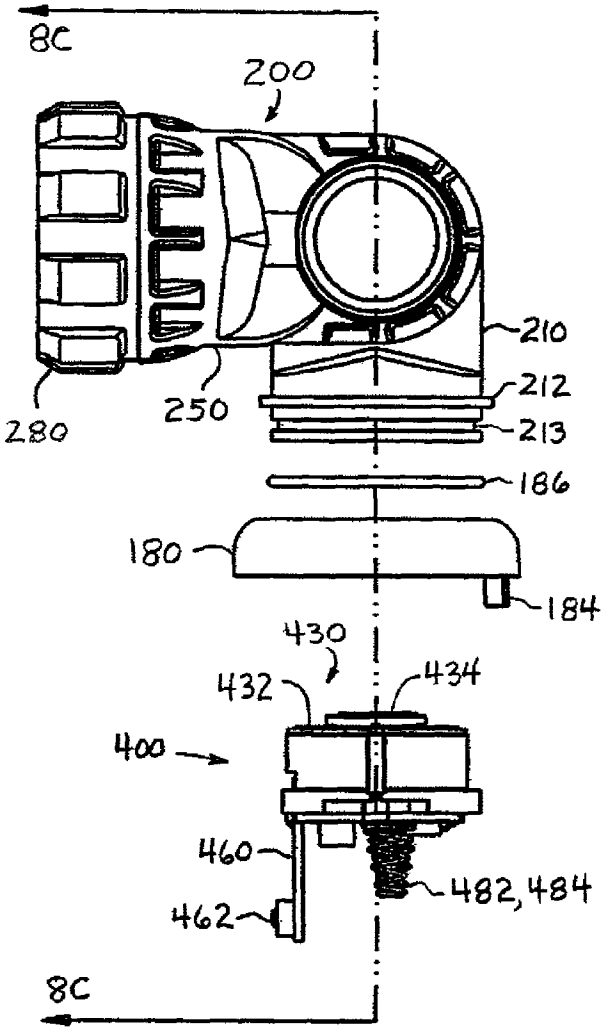
FIGS. 8A, 8B and 8C are exploded front and side views and a cross-sectional view, respectively, of the head assembly of the example portable light.
Figure 8A:
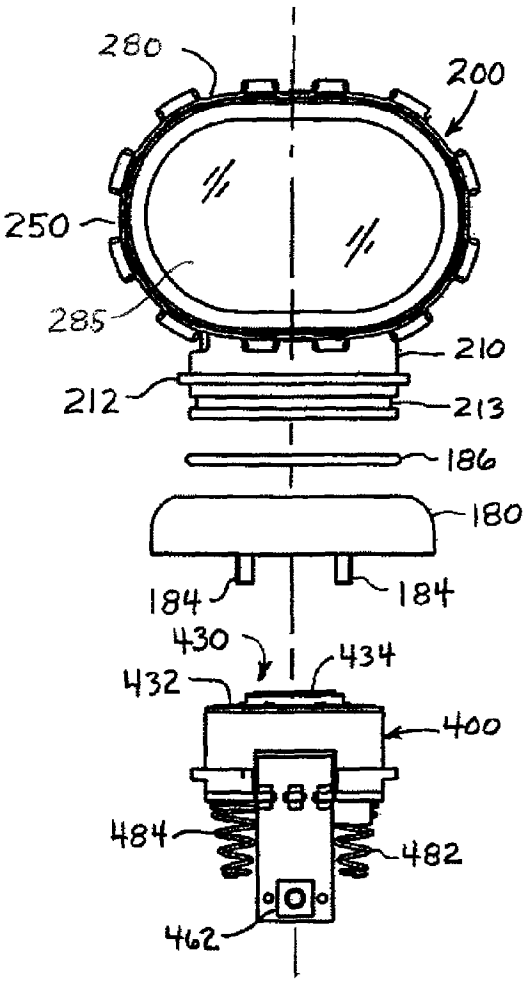

Details of portable light 10 and its component parts are further described and the assembly of light 10 is described in relation to FIG. 5 which is an exploded view of the example portable light 10, FIGS. 6A and 6B which are an exploded view of the rear side of the example light body 100 and a perspective view of an example hanger housing assembly 300, respectively, and FIGS. 8A and 8B which are exploded front and side views, respectively, of head assembly 200.

Light body 100 typically includes a molded housing 110 that has an internal cavity into which a source of electrical power, typically a battery, may be placed for energizing light 10, such as through a covered opening in its base 120. Preferably, the battery includes a battery pack that includes plural batteries, e.g., 4 size AA batteries, in a shaped case, e.g., a molded plastic case. The battery or batteries may include a single-use battery, e.g., an alkaline cell battery, or may include a rechargeable battery, e.g., a NiMH or a lithium-ion cell battery.

A switch 160 on one side of light housing 110 controls operation of light 10. Switch 160 includes a pushbutton actuator 162 that is disposed in opening 118 of housing 110 and is maintained therein by retainer ring 164. Pressing on actuator 162 causes it to move inward into opening 118 and to press against an electrical switch 162 therein.

Head assembly 200 is rotatably attached to the upper end of light body 100 and is retained thereon by retainer ring 180. Head assembly 200 includes a pivot base 210 that interfaces with housing 110 and provides part of a pivotable connection to light source or light head 250. The base end of pivot base 210 has an outward circular flange 212 and has a groove 213 for receiving an O-ring 186 that seals the rotating joint between head 200 and light body 100. Housing 110 has an outward circular flange 112 at its upper end that is of like size to flange 212 of head 200, and that defines a groove 111. The cylindrical end of pivot base 210 slips into the circular opening of housing 110 and circular flanges 112 and 212 are adjacent each other. Retainer ring 180, is typically a split ring (a ring 180 having a split 181) that can be spread apart so that it can be placed over flanges 112, 212 and then brought back together so as to hold flanges 112, 212 captive, and can be secured in a closed condition. O-ring 186 bears against both parts 110, 210, to provide a rotatable seal.

A generally cylindrical electronics and switch assembly or module 400 fits into the opening at the upper end of housing 110 and includes various electrical and electronic elements for the electrical operation of light 10. Module 400 includes outer and inner circular contacts 432, 434 on its one end and has a circuit board 460 extending axially from its outer surface that carries an electrical switch 462 at its far end. When module 400 is placed into the opening at the upper end of housing 110, circuit board 460 extends into the interior of housing 110 to locate switch 462 behind the pushbutton switch 160 so that it is actuated when actuator 162 is pressed. Module 400 preferably has two battery contacts 482, 484 extending into the interior cavity of housing 110 and is maintained in housing 110 by fasteners 408.

Assembly of the rotatable joint between light body 100 and head assembly 200 is preferably as follows. First, module 400 is placed into housing 110 and optionally is fastened 408 therein, either before or after switch actuator 160 and/or cover 130 are assembled to housing 110. Pivot base 210 of assembled head 200 with O-ring 186 in groove 213 of pivot base 210 is slipped into the circular opening of housing 110 until flanges 112, 212 are adjacent. Then retainer 180 which has a groove 182 in the inner surface thereof is placed over flanges 112, 212 so that flanges 112, 212 are captive in the groove 182 thereof, thereby to prevent separation of light body 100 and head assembly 200 while providing a rotatable joint therebetween. Retainer 180 may be secured in a closed position by any suitable arrangement.

A preferred arrangement for securing retainer ring 180 in its closed position on light 10 employs a cooperation of various features of retainer ring 180, of light housing 110 and optionally of an element attached to light housing 110, e.g., hanger assembly 300. Specifically, retainer 180 has projections, e.g., prongs, 184, one on either side of the split 181 therein, that extend axially, e.g., in the direction of housing 110 when retainer 180 is on housing 110. Prongs 184 move apart when ring 180 is spread and come closer together when ring 180 is closed. Housing 110 of light body 100 has complementary recesses 104 at the upper end thereof that are spaced apart by substantially the same distance as are prongs 184 when retainer 180 is closed, so when retainer ring 180 is placed onto housing 110 and closed, prongs 184 become disposed in recesses 104 thereby to maintain retainer ring 180 in the closed condition.

The respective sizes, shapes and locations of prongs 184 and recesses 104 preferably cause prongs 184 to "snap" into and remain in recesses 104. However, additional security against retainer 180 opening may be provided by a member that attaches to housing 110, e.g., hanger housing 300, wherein hanger housing 310 has a pair of recesses 304 at the upper end thereof that is adjacent retainer 180 when hanger housing 310 is attached to light body 100. Recesses 304 are located and spaced apart so that the portion of prongs 184 that are not fully in recesses 104 will be in recesses 304, thereby to prevent displacement of prongs 304 that could allow split retainer ring 180 to open. The arrangement of pivot base 210, housing 110 and retainer ring 180 advantageously facilitate efficient assembly of light 10.

The base 120 of housing 110 has a hinged cover 130 that covers the opening to the battery cavity of housing 110. Cover hinge 140 is provided by the hinge plates 144 molded in housing 110 and hinge plate 134 at one end of cover 130, each of which have a hole therethrough into which hinge pin 144 is placed. The opposite end of cover 130 has latch clip 136 disposed in holes in cover 130 that clips over latch projection 116 of housing 110 thereby to provide cover latch 150. Cover 130 typically has an O-ring 138 for sealing the opening of housing 110. Cover 130 may also include charging contacts 135, 137 for connecting a rechargeable battery inside of light body 100 to an external source of charging power, e.g., a charger, when a rechargeable battery is utilized. Preferably, a rechargeable battery may be a battery pack that includes plural batteries, e.g., 4 size AA NiMH or lithium-ion cell rechargeable batteries, in a shaped case, e.g., a molded plastic case.

Hanger housing assembly 300 includes a housing 310 that attaches to one side of housing 110 for preferably providing a hanger 330 and magnets 340 by which light 10 may be supported from a suitable object. It is noted that hanger housing 310 preferably has two locking recesses 304 at one end thereof that may receive projections 184 for securing retainer ring 180 on housing 110 as described above. Hanger housing 310 is shaped at its base to generally fit against housing 110 and to cover receptacles 108 thereof which are to receive the fasteners 348 that attach hanger housing assembly 300 to housing 110.

Hanger housing 310 is shaped at its exposed side to provide for hanger 330 and magnets 340. Track 320 of housing is an elongated opening that presents as an elongated slot 320 on the surface of housing 310 and that is of greater width within housing 310 so that a hanger 330 having an enlarged end 332 in track 320 is retained therein and is movable therein. Track 320 may be generally circular in cross-sectional shape, e.g, so as to retain a generally spherical end 332 of hanger 330 therein. Where the thickness of hanger housing 310 is less than the diameter of enlarged end 332 of hanger 330, track 320 may also include a recess 119, e.g., a curved recess 119 in housing 110 that cooperates with the shape of the part of track 320 provided by housing 310 to provide a track 320 having more of a complete circular cross-sectional shape.

Hanger 330 has a hanger portion 334 for being placed on or over an object from which light 10 is to be suspended or hung, has a shaft portion 336 into which an offset is provided so that hanger 330 may be placed to lie generally flat on housing 310, and has an enlarged end 332 that rides in track 320 of housing 310 so that hanger 330 may be moved to various locations and positions relative to light body 100. Enlarged portion 332 may be generally spherical in shape as illustrated so that hanger 330 may be moved or may move relatively freely relative to housing 310 and light body 100. E.g., hanger 330 may be moved along the length of track 320, shaft portion 336 may be angled to any position within a generally cone-shaped volume of positions relative to housing 310, and hanger 330 may be rotated about the axis of shaft portion 336 so that hook end 334 has essentially 360° of rotation relative to housing 310. While hanger 330 may be hook-shaped as illustrated in a preferred embodiment, it may have any desired shape in view of how it will be utilized, e.g., an eye shape, a tee shape, a loop shape, a nail-head shape, or a combination thereof.

Preferably, the exterior surface of housing 310 is shaped so as to provide a recess, groove and/or track 350 generally of like shape to hanger 330 so that hanger 330 may be placed into recess 350, e.g., for storage. While the shape and size of recess 350 may be made to receive hanger 330 in a manner that retains hanger 330 therein, retention of hanger 330 in recess 350 may be provided by other features, e.g., by projecting tabs or lips 343 that extend towards recess 350 from magnet receptacles 342. As illustrated, recess 350 is generally hook or oval shaped to correspond to the hook 334 shape of example hanger 330. Preferably, groove 350 is arranged so that when hanger 330 is therein, hanger 330 is substantially flush along the hanger housing 310 in a way that it is not likely to interfere with attaching light 10 to an object using magnets 340.

Hanger housing 310 preferably has a plurality of cup-shaped magnet receptacles 342 into which circular magnets 344 which are inside magnetic metal cups 346 are placed to provide the plural magnets 340. Preferably a recess 345 may be provided on the reverse side of hanger housing 310, e.g., under each of magnet receptacles 342, so that fastener receptacles 108 that extend from housing 110 may extend into recesses 345 for helping to properly position housing 310 on light body housing 110.

As a result of the combination of a hanger 330 that travels along the length of track 320 thereby to allow light 10 to be hung with either end of light body 100 in an upward orientation and/or of magnets 340 which allow light 10 to be attached to suitable metal objects, light 10 is generally suitable for use in industrial and automotive applications as well as by police and fire fighters and other responder personnel. The provision of a hanger 330 and/or magnets 340 allow for hands-free use, if desired. The flexibility in use provided by hanger 330 and magnets 340 is complemented by the ability of light head 250 to rotate at least 360° about light body 100 and also rotate (pivot) about 180° about pivot base 210, whereby the light produced by light head 250 may be easily directed in virtually any direction a user may desire.

Hanger housing assembly 300 is preferably assembled as follows. Hanger 330 is placed in track 320 from the rear of hanger housing 310 before housing 310 is attached to housing 110, e.g., because the slot 320 in hanger housing 310 is narrower than is the enlarged end 332 of hanger 330 and is wider than is the shaft 336 of hanger 330. Magnets 344 are placed into magnet cups 342 which are placed into receptacles 342 of hanger housing 310. Hanger housing 310 is placed against housing 110 so that prongs 184 of retainer ring 180 are in recesses 304 of hanger housing 310 and so that fastener receptacles 108 are in the recesses 345 at the rear of magnet receptacles 342, and then fasteners 348 are fastened through magnets 340 and housing 310 into fastener receptacles 108 thereby to attach hanger housing assembly 300 to housing 110.

The arrangement of housing 310, track 320 hanger 330 and magnets 340 advantageously facilitate efficient assembly of light 10.

Figure 7:
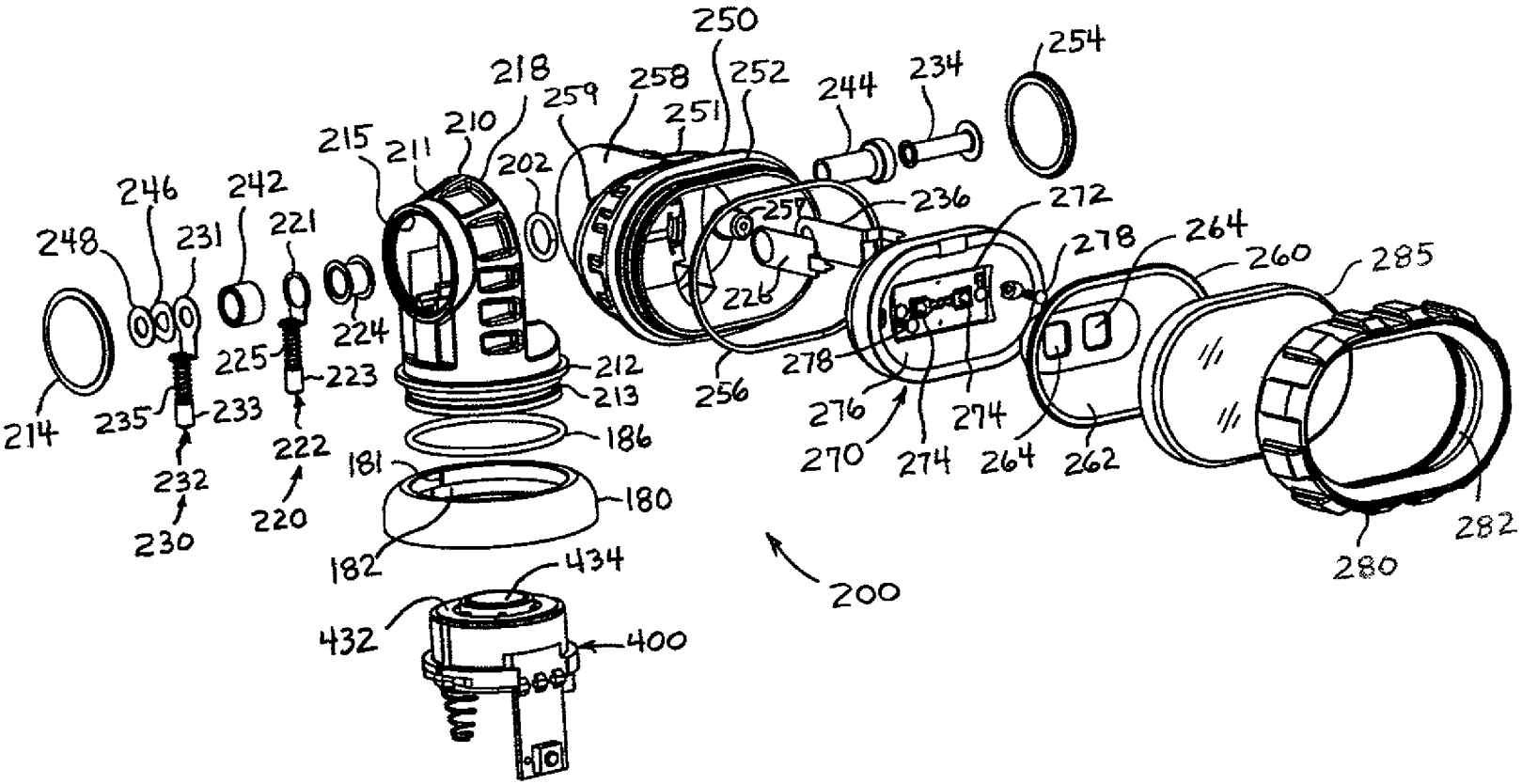
FIG. 7 is an exploded view of the head assembly of the example portable light.
Figure 8C:
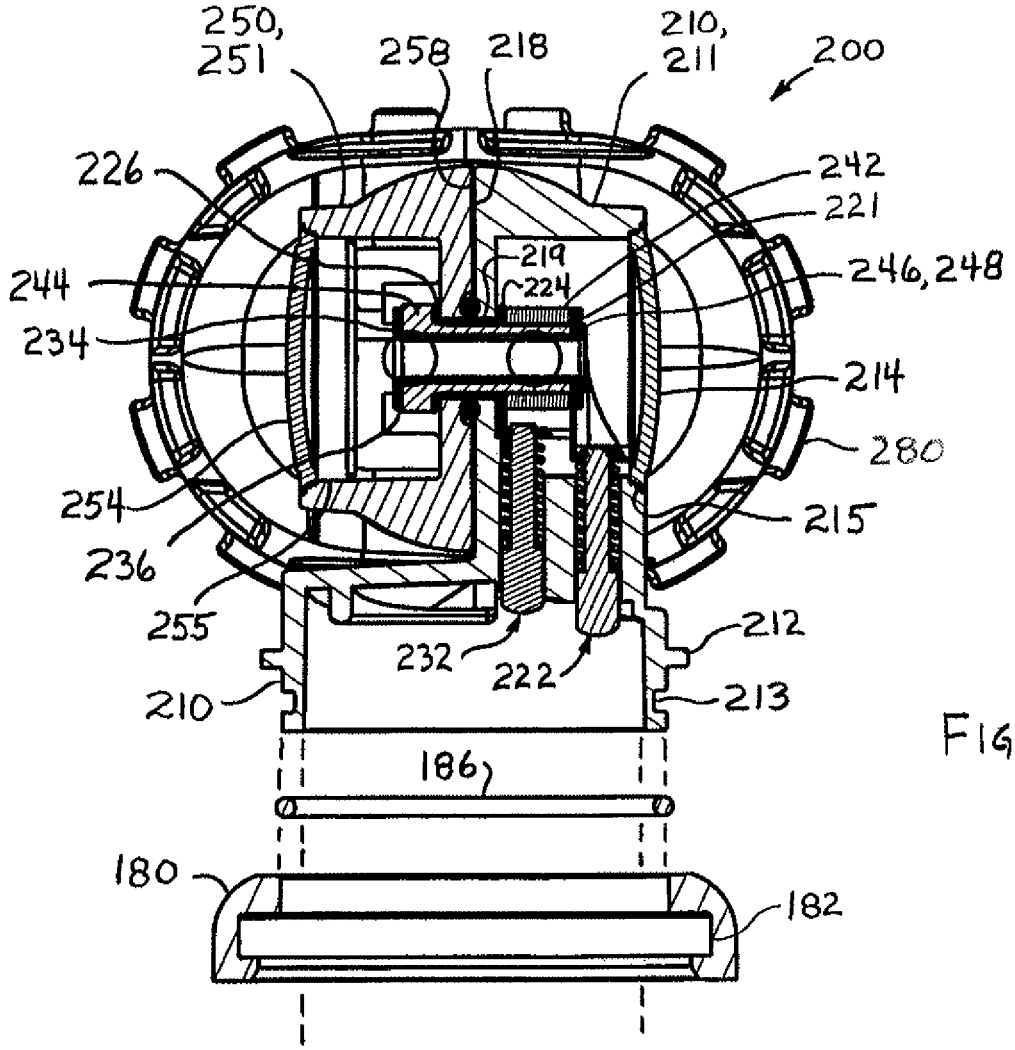

Head assembly 200 is further described and its assembly is described in relation to FIG. 7 which is an exploded view of a head assembly 200 of the example portable light 10, and to FIGS. 8A, 8B and 8C which are exploded front and side views and a cross-sectional view, respectively, thereof. Pivot base 210 is preferably a molded housing 211 that has a surface 218 that is at about 90° to the plane of the rotary joint provided by flanges 112, 212 and retainer ring 180. Light head 250 is preferably a molded housing 251 that has a surface 258 that is at about 90° to the plane of the LED assembly 270 and lens 285 thereof. When light head 250 is pivotably attached to pivot base 210, surfaces 218 and 258 of housings 211, 251 are adjacent and move relative to each other when light head 250 is pivoted relative to pivot base 210, and so surfaces 218, 258 may be generally flat or may have other complementary shapes. O-ring 202 therebetween provides a seal between surfaces 218, 258, e.g., for the pivot joint.

As a result the rotation axis of the pivotable joint between pivot base 210 and light head 250 is substantially perpendicular to surfaces 218, 258, and passes through a generally centrally located circular opening 219, 259 in each of surfaces 218, 258 of housings 211, 251 into which the various elements of the pivot joint are placed. The pivot joint not only allows relative movement of light head 250 with respect to pivot base 210, but also provides for electrically conductive connections 220, 230 through the pivot joint so that electrical power from the power source in light body 100 may be applied to the LED light source elements 270 of head 200. Further each of housings 211, 215 of pivot base 210 and head 250 has a respective larger opening 215, 255 for access and convenience in assembling the pivot joint. Plugs 214, 254 cover openings 215, 255, respectively, in housings 211, 215 after assembly of the pivot joint is completed.

The pivot joint is provided by an inner cylindrical metal eyelet 234 that is inside an outer cylindrical metal eyelet 224, and that are separated by a coaxial generally cylindrical insulating spacer 244 therebetween, and provides both for mechanical pivoting and for electrical conduction paths through the pivoting joint. Each of eyelets 224 and 234 has a pre-formed head at one end and is otherwise cylindrical before being crimped into place in head assembly 200.

Outer metal eyelet 224 may be placed through the hole in metal contact 226 and then through the hole 259 in head housing 251 and through hole 219 in pivot housing 211, with eyelet 224 passing through O-ring 202 between housings 211, 251. Contact assembly 222 is inserted into a hole in pivot base housing 211 that is perpendicular to the plane of the rotating joint of flanges 112, 212, so that contact pin 223 thereof extends towards electronic module 400 for making electrical connection to circular contact 434 thereof under the urging of spring 225 thereof when head assembly 200 is assembled to light body 100. The end of outer metal eyelet 224 protruding inside housing 211 is placed through metal ring 221 of contact assembly 222. While metal eyelet 224 is pressed inwardly into place through holes 219, 259 through the opening 255 in housing 251, metal eyelet 224 is crimped down over contact ring 221, whereby a first electrical connection 220 is made through the pivot joint via metal ring 221, outer metal eyelet 224 and metal contact 226, while crimped metal eyelet 224 provides the mechanically rotatable pivot joint between pivot base 210 and light head 250.

Insulating spacer 244 may be placed through the center of outer metal eyelet 224. Contact assembly 232 is inserted into a hole in pivot base housing 211 that is perpendicular to the plane of the rotating joint of flanges 112, 212, so that contact pin 233 thereof extends towards electronic module 400 for making electrical connection to circular contact 432 thereof under the urging of spring 235 thereof when head assembly 200 is assembled to light body 100. Inner metal eyelet 234 is placed through the hole in metal contact 236 and through the center opening of insulating spacer 244, and insulating spacer 242 is placed over the protruding end of inner metal eyelet 234 in housing 211. The end of inner metal eyelet 234 protruding into housing 211 passes through contact ring 231 of contact assembly 232. Metal spring (wave) washer 246 and metal washer 248 are placed on the end of inner metal eyelet 234, after which the end of inner metal eyelet 234 is crimped down on metal washer 248, whereby a second electrical connection 230 is made through the pivot joint via metal ring 231, inner metal eyelet 234, metal contact 226, and washers 246, 248.

The resulting assembly is seen in FIG. 8C wherein spring loaded contacts 222, 232 are seen to extend toward electronic module 400 for respectively contacting contacts 434 and 432 thereof upon which they trace respective circular paths when head assembly 200 is rotated relative to light body 100, thereby to provide a wiping contact action. It is also seen that surfaces 218, 258 are adjacent each other with O-ring 202 therebetween, and either or both of surfaces 218, 258 may have a circular groove for receiving O-ring 202. The coaxial assembly of cylindrical eyelets 224, 234 and insulators 242, 244 providing a mechanically rotatable joint about which light head 250 may pivot, e.g., about 180° or more or less, with respect to pivot base 210 may also be seen, as can their respective connections to contact assemblies 222, 232 and metal contacts 226, 236. Plugs 214, 254 are seen in openings 215, 255 for covering the interior of pivot base 210 and light head 250 for sealing the pivot joint assembly.

Light head 250 further includes an LED and heat sink assembly 270 for producing light when energized through the conducting paths 220, 230. LED assembly 270 includes, e.g., at least one light emitting diode (LED) 274, and preferably two LEDs 274 that are on a circuit board 272 and are thermally coupled to heat sink 276. The prong ends of metal contacts 226, 236 preferably extend into and are soldered into electrically conductive holes in circuit board 272 when LED assembly 270 is inserted into the oval shaped opening of light housing 251. LED and heat sink assembly 270 may be attached to light head 250 by fasteners 278 that extend through heat sink 276 and into receptacles 257 of light housing 251.

Reflector 260 has a reflecting portion 262 and has openings 264 in the base thereof in which LEDs 274 become disposed when reflector 260 is placed into the oval shaped opening of light housing 251 adjacent to LED assembly 270. Reflecting portion 262 may be of a desired shape, such as a parabolic shape or a squared (rectangular) trapezoidal shape, as may be desired. Further, the surface or surfaces of reflector 260 are typically smooth or polished or mirrored for better reflectivity, and the reflecting surface or surfaces thereof may be shaped so as to provide a flood light beam or a spot light beam, as may be desired. A squared trapezoidal reflector typically has a rectangular base having one or more openings for one or more LEDs 274, and has four trapezoidal sloped surfaces extending forward toward the plane of lens 285 so as to define a substantially rectangular opening proximate lens 285; such reflector 260 may have a generally planar surface substantially parallel to lens 285 to which planar surface the four trapezoidal surfaces intersect and an oval periphery similar to that of lens 285.

The oval-shaped opening of light housing 251 may have a groove therein for receiving a sealing O-ring 256 therein and lens 285 may be cup shaped so as to press O-ring 256 between the rim of lens 285 and housing 251. Housing 251 may also have a flange around its oval-shaped opening over which groove 282 of resilient face cap 280 fits so as to hold face cap 280 in place on light head 250. Plugs 214, 254 may be placed into openings 215, 255 of housings 211, 251, respectively, after the pivoting joint is completed. The arrangement of pivot base 210, light head 250 and the elements of the pivot joint 220-244 advantageously facilitate efficient assembly of light head 200.

Figure 9B:
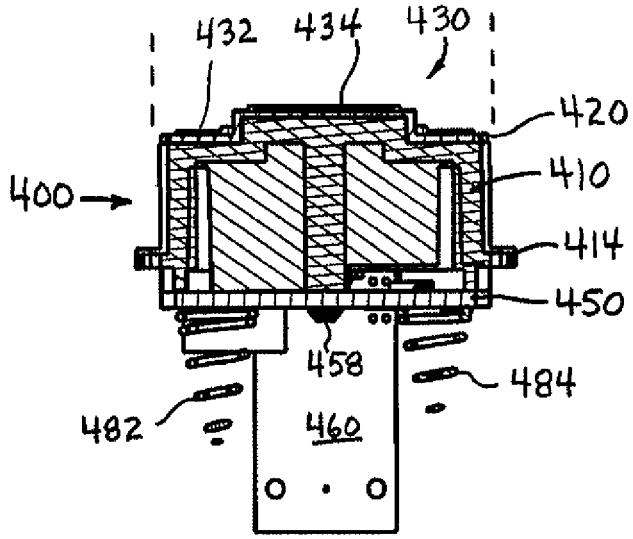
FIGS. 9A and 9B are an exploded view and a cross-sectional view, respectively, of the electronic assembly.
Figure 9A:
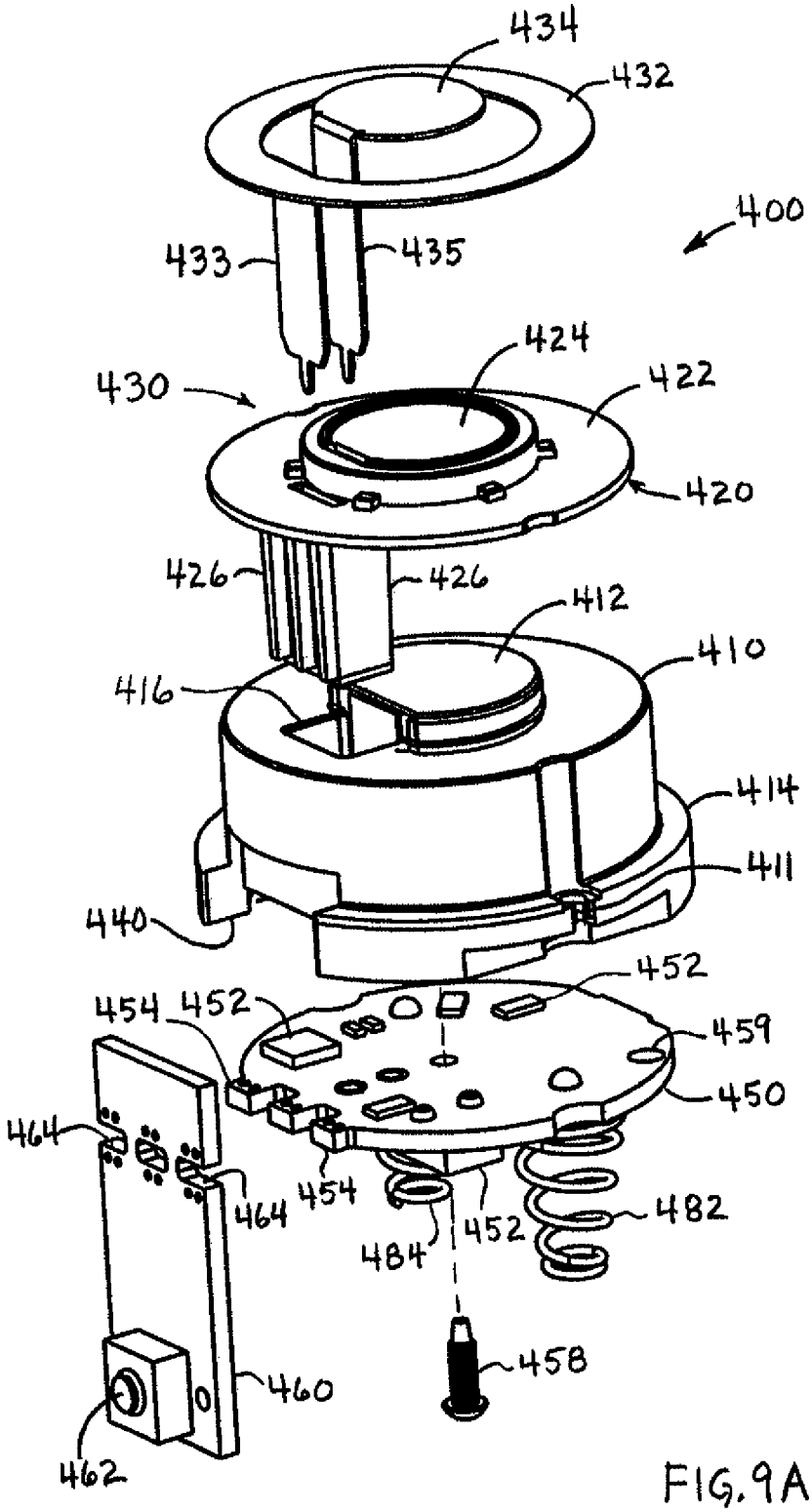
Figure 9C:
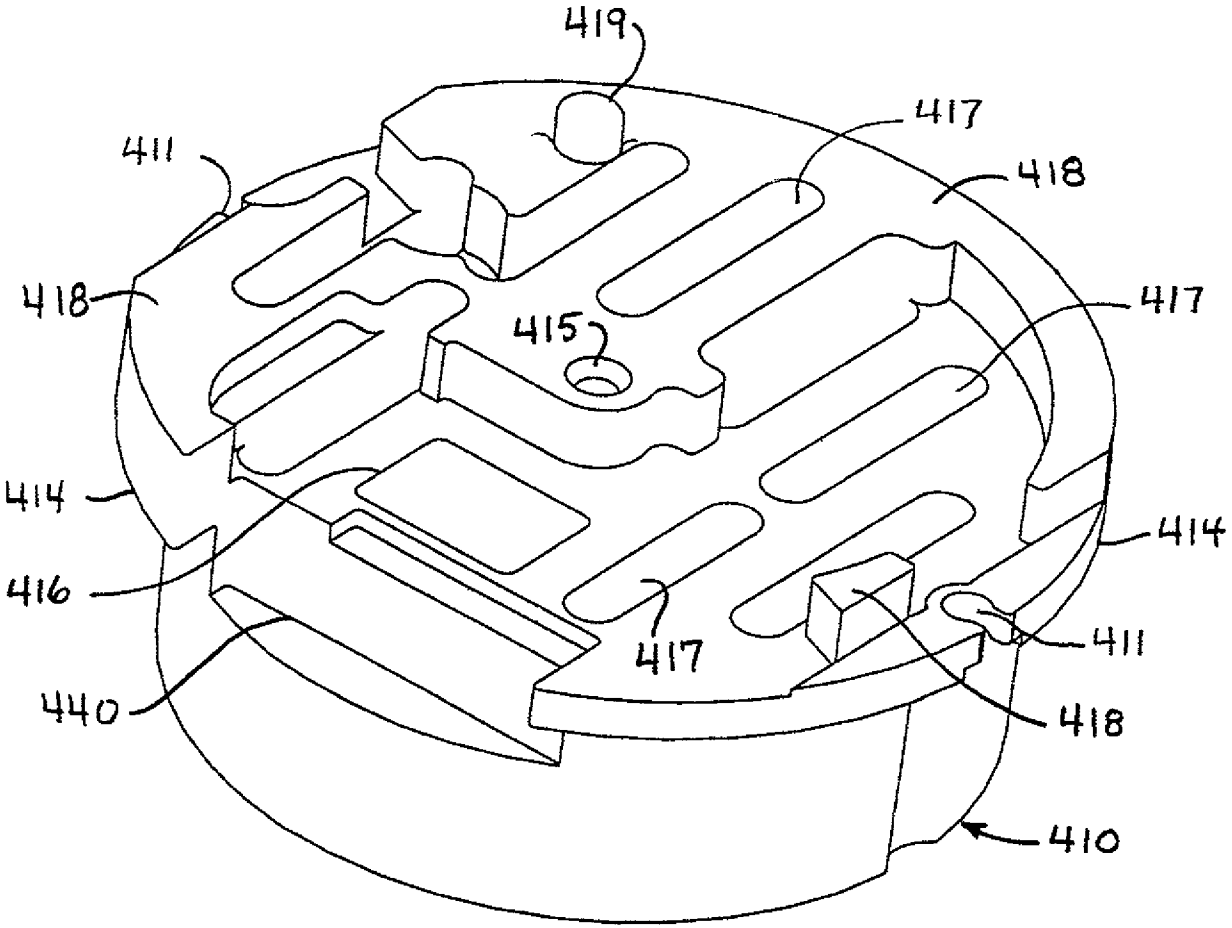
FIG. 9C is a perspective view of a heat sink member thereof.

Electronics and switch assembly or module 400 is described in relation to FIGS. 9A and 9B which are an exploded view and a cross-sectional view, respectively, of the electronic assembly 400 of the head assembly 200, and FIG. 9C which is a perspective view of a heat sink member thereof. Generally cylindrical heat sink 410 defines the general shape of module 400 and provides for dissipating heat generated by the various electronic components 452 that are mounted on circuit board 450 for controlling the application of electrical power from a power source in light body 100 to light head 250, e.g., LEDs 274, for producing light responsive to switch 160, 462. Heat sink 450 may have a flange or base 414 extending from its outer cylindrical surface for positioning module 400 in the circular opening at the top of light body 100, e.g., housing 110, and may also have one or more openings 411 through which a fastener or fasteners 408 may be placed to secure module 400 in housing 110.

Circuit board 450 of generally circular shape is disposed adjacent to heat sink 410 and is thermally coupled thereto, e.g., to surface 418 thereof. Opening 459 of circuit board 450 engages post 419 of heat sink 450 for maintaining a desired positional relationship therebetween. Heat sink 450 as illustrated has a plurality of openings 417 or voids extending from surface 418, however, heat sink 450 may have different openings 417 or may have no openings (i.e. be substantially solid) in any particular embodiment. It is thought that air may circulate in voids 417 which may help remove heat from heat sink 450. In practice, at least some recesses 417 or other recesses would likely be provided where necessary to allow clearance for electronic parts 452, if any, that are on the side of circuit board 450 that is adjacent heat sink 410. An insulating member may be placed between heat sink 410 and circuit board 450 to prevent electrical connection therebetween.

Circuit board 450 may have two springs 482, 484 extending therefrom in a direction into light body 100, e.g., for making electrical connections to a battery or other electrical power source therein. Plural tabs 454 extend from circuit board 450 and are disposed in openings 464 of switch circuit board 460 for making electrical connection to conductors thereon, e.g., typically by soldering. E.g., two or three conductors may be on circuit board 460 for connecting switch 462 to the circuitry of circuit board 450. Circuit board 450 may be secured to heat sink 410 by a fastener 458 through a central hole therein and seated in central hole 415 of heat sink 410.

Thus, circuit boards 450, 460 may be assembled and maintained in a particular positional relationship, e.g., substantially at right angles to each other, once soldered or other wise secured. Switch circuit board 460 carries electrical switch 462 which extends into housing 110 and the operation of which via switch actuator 160, 162 controls operation of light 10, e.g., by controlling the operation of electronic circuitry on circuit board 450. The upper end of circuit board 460 may be disposed in a recess 440 in the cylindrical outer surface of heat sink 410, e.g., for further support. Preferably, circuit board 460 may be disposed in a channel inside housing 110 for aiding in positioning switch 462 relative to switch actuator 160, 162.

The upper circular end of heat sink 410 may have a central circular pedestal 412 extending therefrom onto which an insulating member 420, e.g., shaped like a short top hat, is placed for insulating conductor rings 430 from heat sink 410. Conductor rings 430 include an inner circular contact 434 from which a conductor 433 extends and an outer annular contact 432 from which a conductor 435 extends. The circular portion of contact 434 is preferably seated in and positioned coaxially by a recess 424 of insulator 420 with conductor 435 thereof extending downward in an axial direction in a space between two of insulating guides 426. The circular annular portion of contact 432 is preferably seated on and positioned coaxially by a seat 422 of insulator 420 with conductor 433 thereof extending downward in an axial direction in a different space between two of insulating guides 426. Insulating guides 426 are disposed in opening 416 of heat sink 410 and conductors 433, 435 extend to and are connected to respective contacts of circuit board 450, e.g., the narrowed ends of conductors 433, 435 and connected in respective holes of circuit board 450.

Figure 10A:
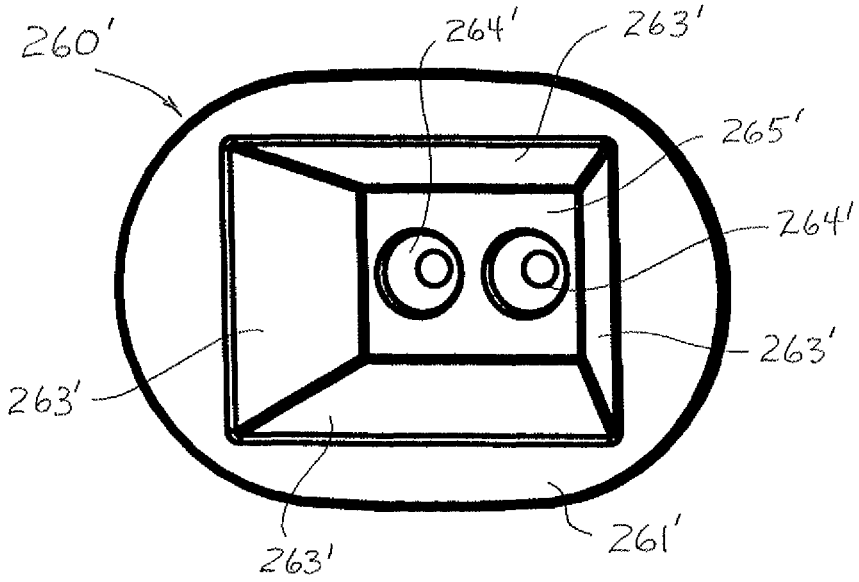
FIG. 10A is a perspective view of an example reflector useful with the example portable light.
Figure 10B:
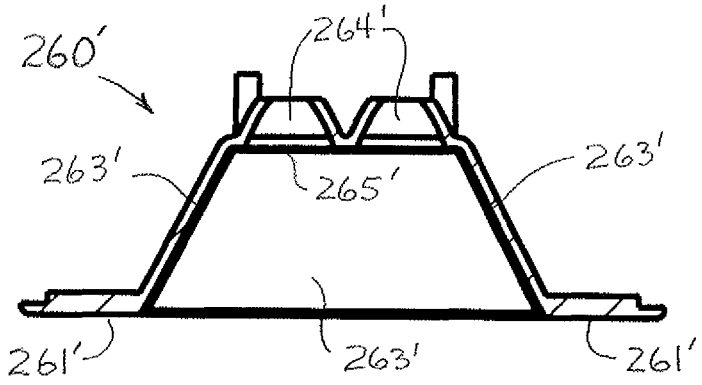
FIG. 10B is a cross-sectional view thereof.

FIG. 10A is perspective view of an example reflector 260' useful with the example portable light 10, e.g., as illustrated in FIGS. 1 and 2, and FIG. 10B is a cross-sectional view thereof. Reflector 260' has a relatively flat oval-shaped front face 261' surrounding its rectangular open front end with face 261' residing adjacent to lens 285. Opposite front face 261' is a smaller rectangular rear face 265' in which are one or more openings 264' in which one or more LEDs 274 reside when reflector 260' is situated in head 250. Between front face 261' and rear face 265' are four generally trapezoidal reflective faces 263' defining a generally "rectangular cone" between front and rear faces 261', 265'.

Typically, the surfaces of trapezoidal faces 263' have a reflective surface for reflecting light produced by LEDs 274 and face 265' may have a like finish, as may face 26I'. The reflective surface finish may be, e.g., polished, silvered, smooth, textured, or any other suitable finish, as may be convenient for obtaining a particular light quality, e.g., relatively sharper or relatively diffuse. The relative sizes of rear face 265' and the angle or angles at which trapezoidal faces 263' are positioned may be set as may be convenient for obtaining an appropriate shaping of the light produced by LEDs 274 into a beam, e.g., a spot beam, a flood beam, or another beam.

Figure 12:
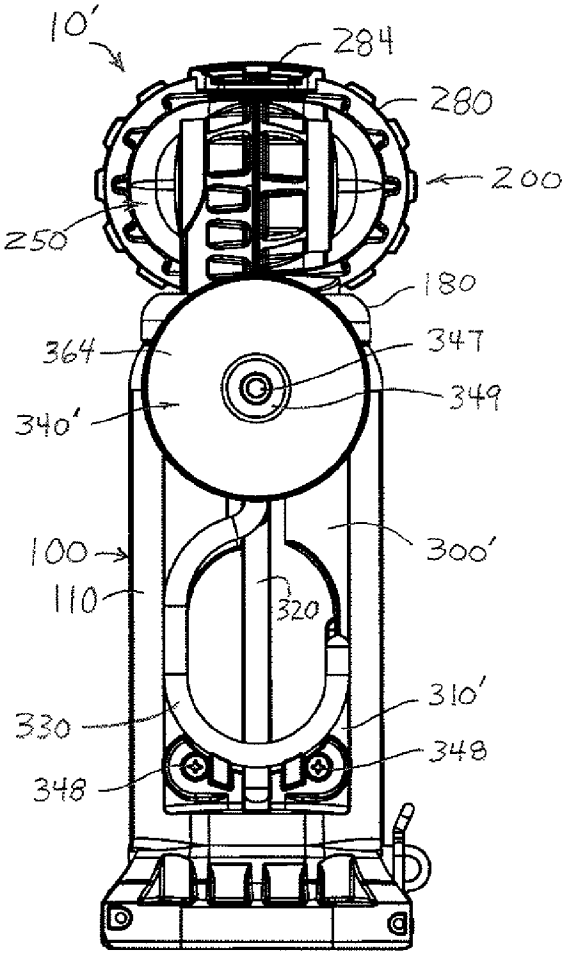
FIG. 12 is a rear view of the example portable light of FIG. 11.
Figure 11:
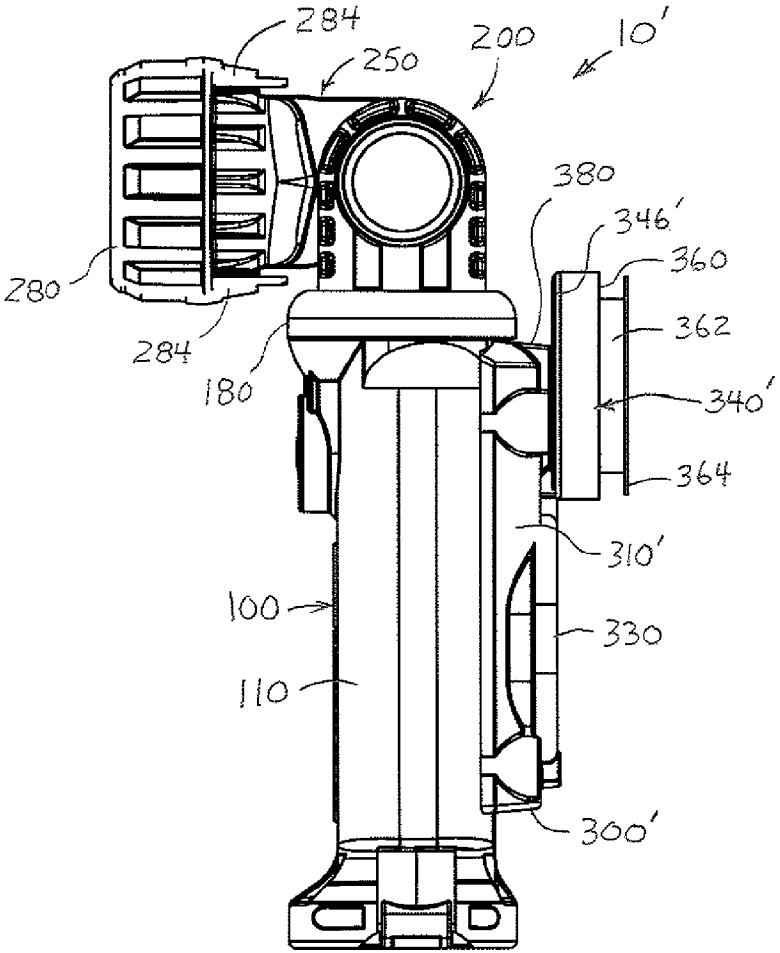
FIG. 11 is a side view of an example embodiment of a portable light having a magnet and a hanger.
Figure 13:
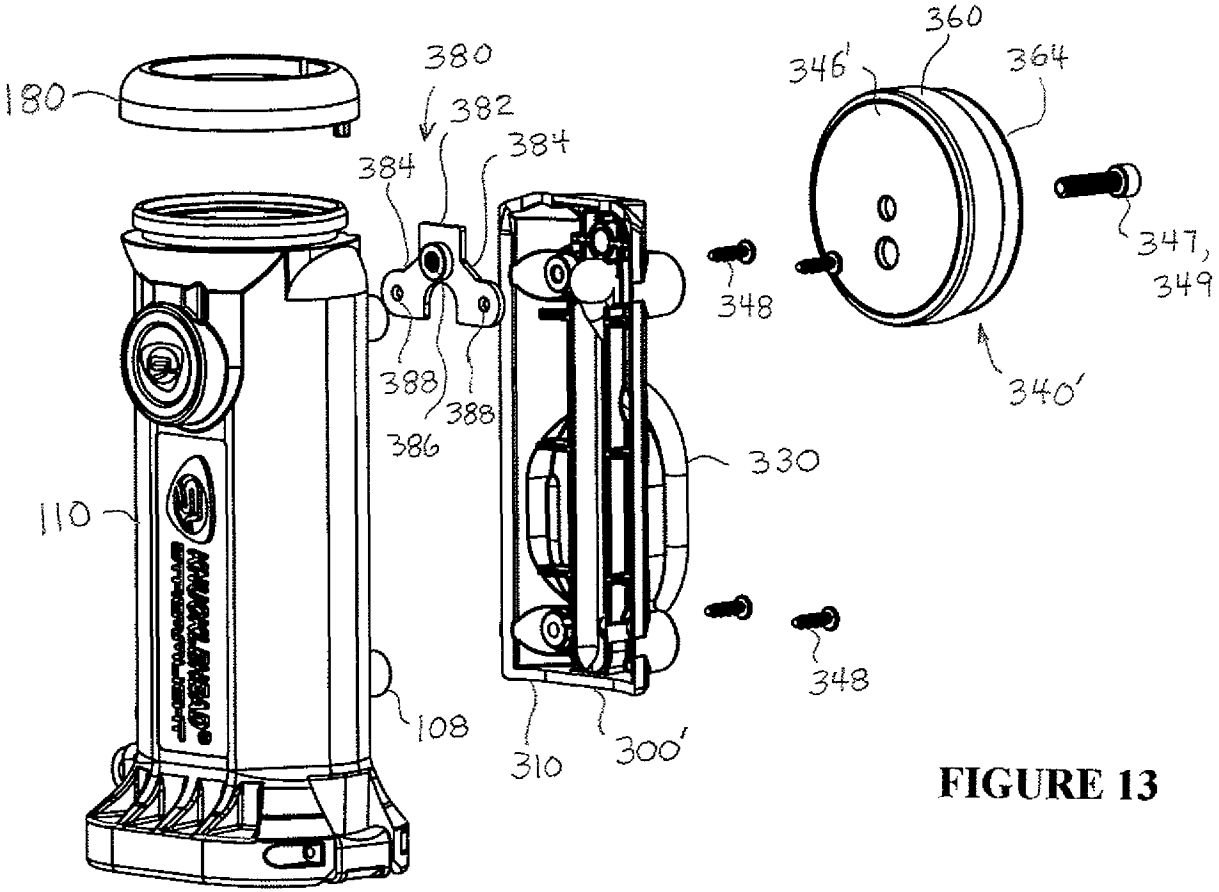
FIG. 13 is an exploded view of the magnet assembly of the example portable light of FIGS. 11 and 12.

FIG. 11 is a side view and FIG. 12 is a rear view of an example portable light 10', and FIG. 13 is an exploded view of the magnet assembly 300' of the example portable light 10' of FIGS. 11 and 12. Light body 100 and light head assembly 200 of light 10' are as described herein and operate as described herein in relation to light 10. Example light 10' differs in that hanger housing assembly 300' includes a magnet 340' that is nearer an upper end of hanger housing 310' in addition to hanger 330. Hanger housing assembly 300' includes a housing 310' that is attached to light body housing 110 by fasteners 348 and includes a hanger 330 that is movable in track 320 and is stowable in housing 310' as described herein.

Magnet 340' is attached nearer the upper end of housing assembly 300' by washer 347 and fastener 349 passing through respective holes in magnetic member 344', cup 346', receptacle 342' and hole 312 of housing 310' to engage member 380. Member 380 includes a base 382 from which extend two extension arms 384 in a V configuration. Arms 384 have respective holes 388 through which pass fasteners 348 to engage holes 108 of housing 110 thereby securing member 380 between housing 310' and light body housing 110 of light 10'. Fastener 349 engages opening 386 of base 382 of member 380 to attach magnet 340' to light 10'. Preferably, member 380 may be a plastic part and hole 386 may be a metal insert that extends into opening 312 of housing 310', e.g., for aligning and/or stabilizing member 380.

Magnet 340' typically includes, e.g., a central generally cylindrical magnetized member 344' that resides in a cylindrical metal cup 346', preferably a steel cup 346', in similar manner to magnet 340 as described herein. The foregoing of magnet 340' are attached to light 10' by fastener 349 passing through into member 380 and by optional washer 347. Preferably, magnet 340' is sufficiently strong to securely attach light 10' to an irregular surface of an object including a ferromagnetic material, e.g., a steel, as may be convenient in placing a light at various locations on an automobile or other vehicle or machinery. A circular spacer 362 and thin steel washer 364 may be provided on the face of magnet 340' for protection during shipping, and may be discarded prior to use. Optionally, but preferably, magnet 340' may be provided with a rubber or other resilient cover 360 (described below) to protect a surface to which light 10' may be attached by magnet 340'. Magnet 340' and/or hanger 330 may be used alone or in cooperation for attaching light 10' is a desired location.

Face cap 280 of light 10' (or of light 10) may have at least one clasp 284, and preferably two clasps 284, that engages a feature of housing 251 of light head 250 to retain face cap 280 thereon, either in addition to the engaging of groove 282 and flange 252 or in place thereof. Typically, a projection of housing 251 is engaged by a recess of clasp 284 or a recess of housing 251 is engaged by a projection of clasp 284. Retainer ring 180 may be held closed on light body 100 by a pin, screw or other fastener.

Figure 14A:
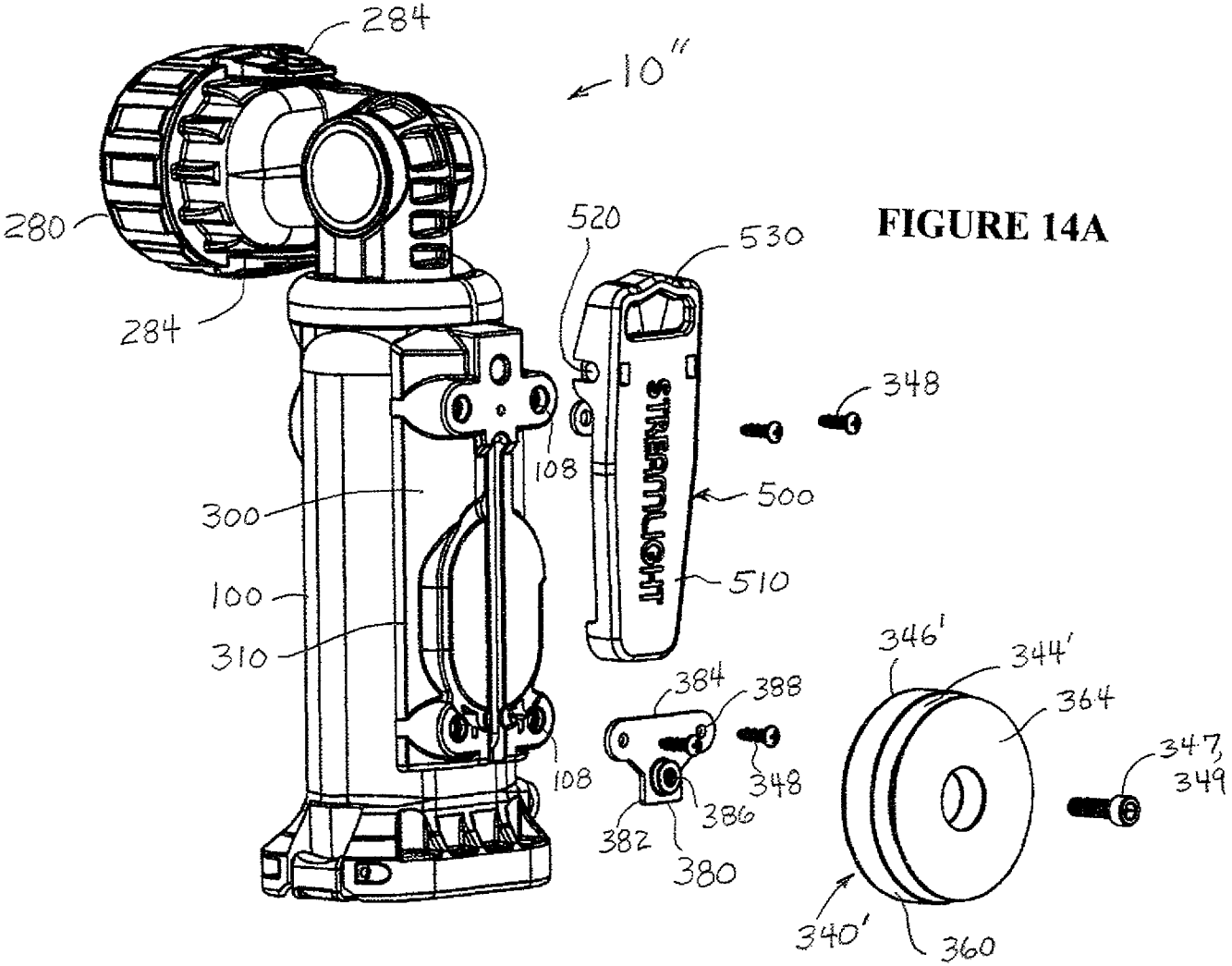
FIGS. 14A and 14B are rear and front exploded perspective views, respectively, of an example embodiment of a portable light having a clip and a magnet.
Figure 14B:
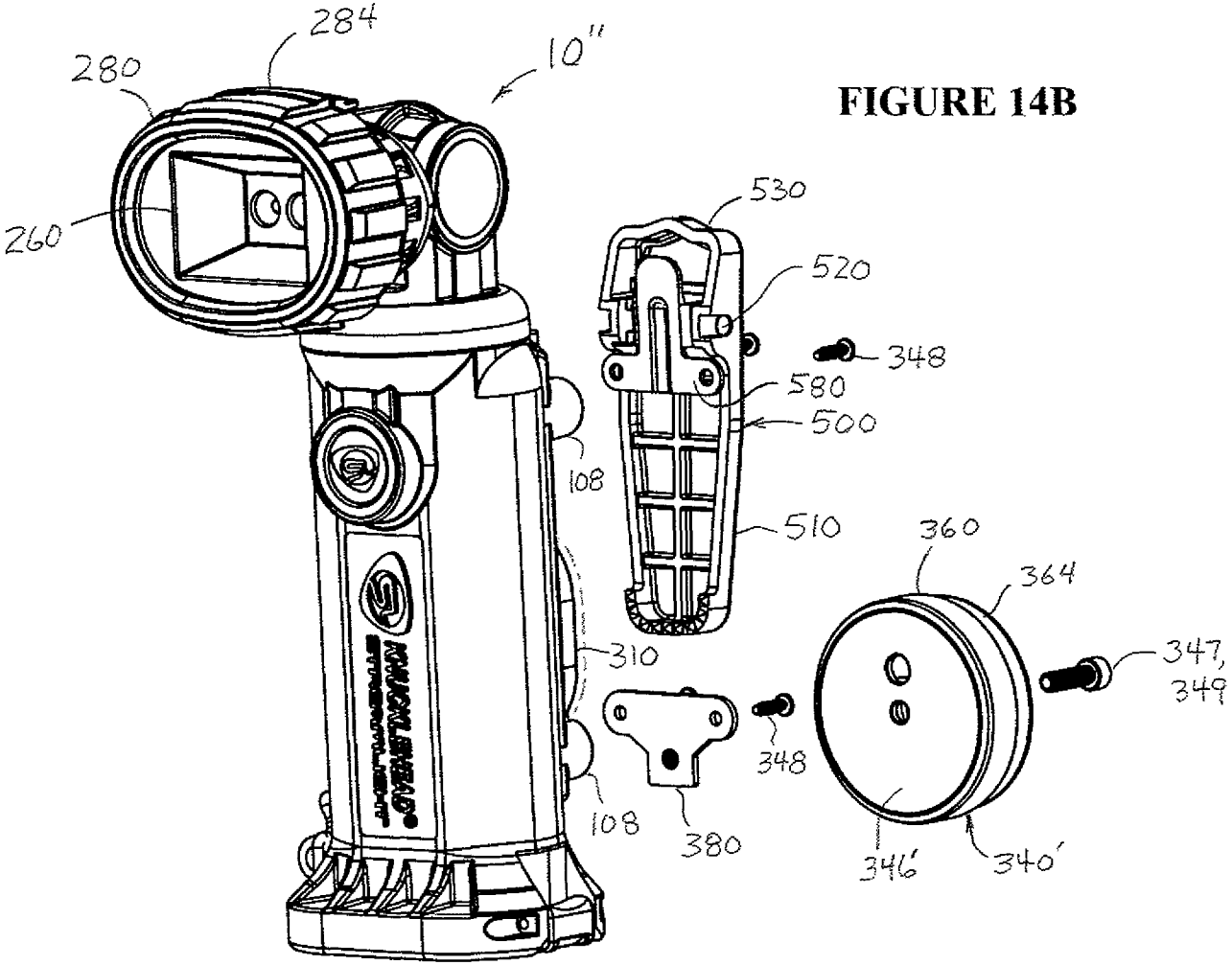

FIGS. 14A and 14B are rear and front exploded perspective views of an example embodiment of a portable light 10" having a clip 500 and a magnet 340' as described herein. Light body 100 and light head assembly 200 of light 10" and hanger housing 310 are typically as described herein and operate as described herein in relation to lights 10 and 10'. Example light 10" differs in that hanger housing assembly 300' includes a magnet 340' that is nearer a lower end of hanger housing 310 and a clip 500, but light 10" does not include a hanger 330. Even though a hanger 330 is not included, light 10" may utilize the same hanger housing 310, 310' as described herein in relation to lights 10 and 10'.

In this embodiment, magnet 340' is attached to housing 300 nearer the end thereof remote from head 250, e.g., using a member 380 as described herein. A pocket or belt clip 500 is attached to light 10" nearer the upper end of light body 100, e.g., to a projection extending from hanger housing 310, e.g., as by a member similar to member 380, but including a projection, and attached to light 10" as described in relation to member 380 herein. Clip 500 preferably has a relatively longer extension 510 that extends along the body 100 of light 10" and that is pivotable so that the distal end thereof may be movable closer to an further away from housing 300.

Pivotable clip 500 may be retained to light 10" by a pivot pin 520 passing transversely through clip 500 and through a projection extending from pivot support 580 which is attached to hanger housing 310 by fasteners 348. Clip 500 is biased to move towards and bear against hanger housing 310. Alternatively, and preferably, clip 500 may be attached using a bracket 580 which is similar to bracket 380 and to which clip 500 is attached by pivot pin 520. Bracket 580 is attached to receptacles 108 of housing 110 by fasteners 348 which pass through hanger housing 310. Typically, a spring, e.g., a coil spring with extended ends or a spring strip, may be employed for biasing extension 510 of clip 500 towards housing 310.

Optionally, but preferably, clip 500 also includes an upper extension 530 extending in a direction opposite to extension 510 and extension 530 preferably defines an opening or loop 530 which can be employed for hanging light 10" on a projection such as a pin or bolt or nail and the like. Clip 500 may be employed for attaching light 10" to a person, article of clothing, a work piece or other object, as may be desired by a user of light 10". Magnet 340' and/or clip 500 may be used alone or in cooperation for attaching light 10" is a desired location.

Figure 15A:
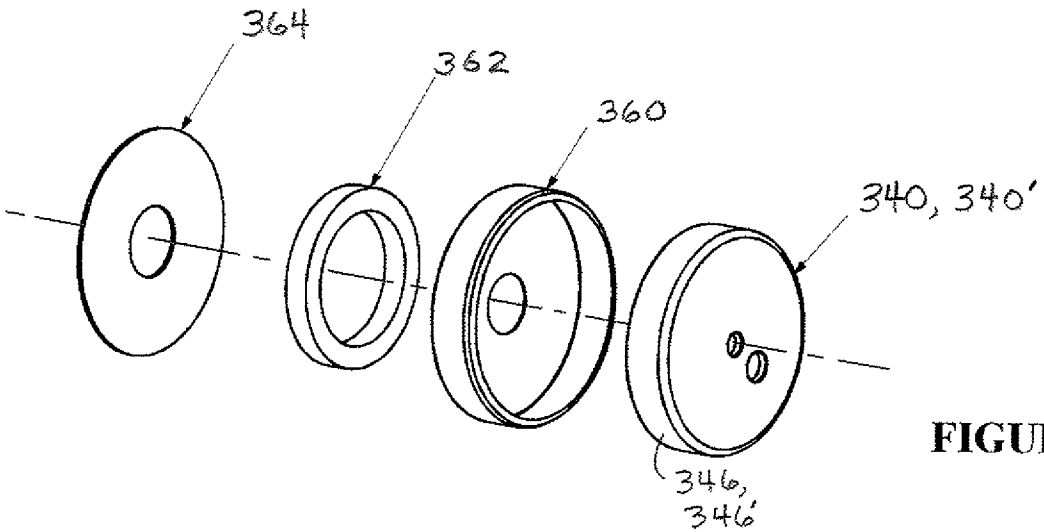
FIGS. 15A and 15B are rear and front exploded perspective views, respectively, of an example embodiment of a magnet useful with a portable light.
Figure 15B:
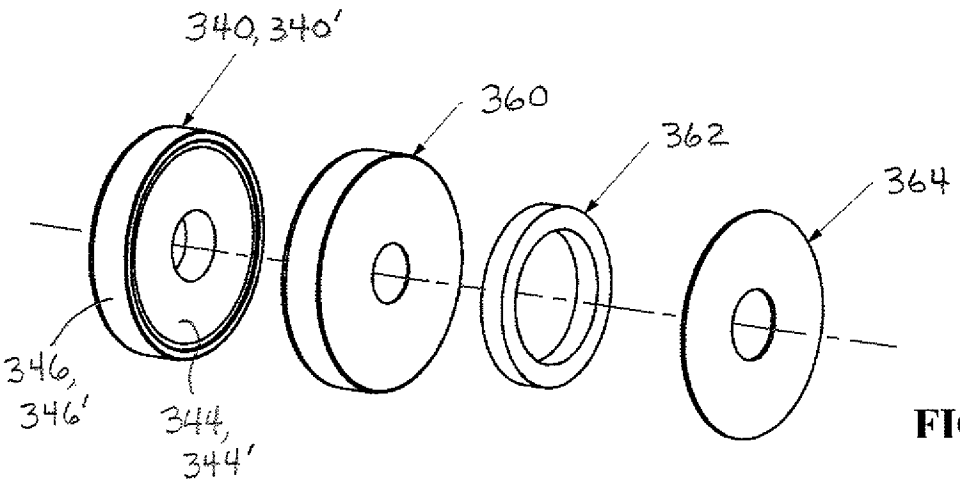

FIGS. 15A and 15B are rear and front exploded perspective views of an example embodiment of a magnet 340, 340' useful with a portable light 10, 10', 10', e.g., as described herein. Magnet 340, 340' comprises a generally circular permanent magnet 344, 344' that is disposed in a cup 346, 346', preferably a ferromagnetic metal cup 346, 346' such as a steel cup 346, 346', as described. Optionally and preferably, a cover 360 fits over magnet cup 346, 346', e.g., as by a friction fit, so as to enclose magnet 344, 344'. More preferably, cover 360 is of a rubber or other resilient material that friction fits on cup 346, 346' and provides a resilient outer surface for protecting objects to which a light 10, 10', 10" might be magnetically attached by magnet 340, 340'. Optionally, a nylon spacer ring 362 may be provided adjacent cover 360 and a thin steel washer 364 may be provided adjacent spacer 362 for shipping light 10, 10', 10" and may be removed by a user prior to use. Spacer 362 and washer 364 may be removably attached by a suitable fastener, e.g., by fastener 347 or by a releasing adhesive or by another suitable fastener.

In one example embodiment, housing 110, pivot base 210, light head 250, retainer ring 180, hanger housing 310, plugs 214, 254, switch ring 164, and cover 130, were molded of a suitable plastic material, e.g., an ABS plastic, nylon, an engineered nylon, an impact-resistant nylon, a modified nylon, or other suitable plastic, and hanger 330 was molded of similar material with reinforcing, e.g., with carbon fiber or glass fiber or other suitable reinforcing. Metal electrical parts, e.g., contacts 222, 232, eyelets 224, 234, contacts 226, 236, contacts 432, 434, may be made of any suitable electrically conducting metal, e.g., copper, brass, beryllium copper and the like. Insulators, e.g., spacers 242, 244, and member 420, may be of any suitable insulating material, preferably a plastic material, e.g., polycarbonate, ABS plastic and the like. Heat sinks 276 and 410 may be of any suitable thermally conductive material, preferably, copper or aluminum. Lens 285 is typically polycarbonate or polystyrene or other suitable plastic or glass, while face cap 280 and actuator 162 may be any suitable resilient or rubbery material, e.g., neoprene, silicone, rubber, melt processable rubber or other suitable material.

A portable light 10, 10', 10" may comprise: a light body 100 having first and second ends and defining an axis 101 between the first and second ends, light body 100 having a track 320 in a direction generally between the first and second ends thereof; a light head 200 having a pivot base 210 mounted at the first end of light body 100 and rotatable about the light body axis 101, light head 200 having a light source 250 pivotably mounted to the pivot base 210 thereof and pivotable relative to the pivot base 210; and a hanger 330 having an end riding in the track 320 of light body 100 and movable therein. Light body 100 and pivot base 210 of light head 200 may have respective circular flanges 112, 212 of like diameter positioned adjacent each other, and may further comprise a retainer ring 180 having a groove 182 on an inner surface thereof, wherein retainer ring 180 is positioned over the respective circular flanges 112, 212 of light body 100 and pivot base 210 to provide a rotatable joint. Portable light 10, 10', 10" may further comprise: a pair of coaxial circular electrical contacts 432, 434 coaxial with the circular flange 112, 212 of one of light body 100 and pivot base 210; and a pair of electrical contacts 222, 232 in the other of light body 100 and pivot base 210, each of the pair of electrical contacts 222, 232 being positioned for contacting a respective one of the pair of coaxial circular electrical contacts 432, 434, whereby at least two electrical conduction paths 220, 230 are provided between light body 100 and light head 200. Retainer ring 180 may be a split retainer ring 180 having a recess on each side of the split 181 therein, or having a projection on each side of the split 181 therein, or having a combination of a recess on one side of the split 181 therein and a projection on the other side of the split 181 therein, and light 10, 10', 10" may further comprise: a member 310, 310' attachable to light body 110, member 310, 310' having spaced apart projections, or spaced apart recesses, or spaced apart projection and a recess, in locations complementary to the recesses or the projections or the recess and projection of split retainer ring 180, wherein the recesses and/or projections of member 310, 310' and split retainer ring 180 engage to keep split retainer ring 180 closed. Portable light 10, 10', 10" may further comprise: a pair of coaxial electrically conductive members 224, 234 separated by a coaxial insulating member 244, wherein the pair of coaxial electrically conductive members 224, 234 separated by a coaxial insulating member 244 may provide the pivotable mount and at least two electrical conduction paths 220, 230 between light body 100 and light head 200. Light head may be rotatable at least 360° about the light body axis 101, or may be pivotable 180° about the base 210; or may be rotatable at least 360° about the light body axis 101 and light source 250 may be pivotable about 180° about the base 210 of the light head 200. Hanger 330 may be movable and/or rotatable in the track 320 to a range of positions relative to light body 100; or may be movable and/or rotatable in the track 320 to a storage position 350 adjacent light body 100; or may be movable and/or rotatable in the track 320 to a range of positions relative to light body 100 and to a storage position 350 adjacent light body 100. Light source 250 may includes a reflector 260, and: reflector 260 may have a parabolic shape or a squared trapezoidal shape; or may be shaped to provide a flood light beam or may be shaped to provide a spot light beam; or may have a parabolic shape or a squared trapezoidal shape and may be shaped to provide a flood light beam or may be shaped to provide a spot light beam. Portable light 10, 10', 10" may further comprise: a clip 500 mounted to a side of light body 100; or at least one magnet 340, 340' mounted to a side of light body 100 for holding light body 100 proximate a metal object; or at least one magnet 340, 340' mounted to a side of light body 100 for holding light body 100 proximate a metal object and a clip 500 mounted to the side of light body 100; or at least one magnet 340, 340' mounted to a side of said light body proximate light head 200 for holding light body 100 proximate a metal object; or at least one magnet 340, 340' mounted to a side of light body 100 remote from light head 200 for holding light body 100 proximate a metal object; or a plurality of magnets 340, 340' mounted to a side of light body 100 for holding light body 100 proximate a metal object. Portable light 10, 10', 10" may further comprise a plurality of magnets 340, 340' mounted to a side of light body 100 for holding light body 100 proximate a metal object. Light body 100 may have a cavity for receiving a battery, and may further comprise a battery in the cavity of light body 100. The battery may be a rechargeable battery. Light body 100 may have a storage recess 350 for receiving hanger 330 wherein hanger 330 is storable in the storage recess 350. Hanger 330 may have a hook shape, an eye shape, a tee shape, a loop shape, a nail-head shape, or a combination thereof.

A portable light 10, 10', 10" may comprise: a light body 100 having first and second ends and defining an axis 101 between the first and second ends, a light head 200 including a pivot base 210 rotatably mounted at the first end of light body 100 and rotatable about the light body axis 101, wherein the rotatable mounting of light head 200 and light body 100 includes an electrical slip ring 222, 232, 430 providing electrical connections 220, 230 through the rotatable mounting of light head 200 and light body 100; light head 200 may include a light source 250 rotatably mounted to the pivot base 210 thereof and rotatable relative to the pivot base 210, wherein the rotatable mounting of light source 250 and pivot base 210 includes coaxial electrically conductive members 224, 234 providing electrical connections 220, 230 through the rotatable mounting of light source 250 and pivot base 210. Light body 100 may have at least one magnet mounted 340, 340' to light body 100, wherein the at least one magnet 340, 340' has magnetic strength sufficient to magnetically support portable light 10, 10', 10". The light body 100 may have a track 320 and may further comprise: a hanger 330 having an end 332 riding in the track 320 of light body 100 and movable therein, wherein hanger 330 is movable to positions over a range of angles relative to light body 100. Light body 100 may further comprise a pivotable clip 500 pivotably mounted to light body 100, wherein pivotable clip 500 has a clipping end 510 biased to bear against light body 100. Light body 100 may comprise a light body housing 110 and a hanger housing 310, 310' attached to light body housing 110, wherein hanger housing 310, 310' may provide the track 320 for hanger 330 or may provide a mount 310, 580 for pivotable clip 500 or may provide both. Light body 100 and the pivot base 210 of light head 200 may have respective circular flanges 112, 212 of like diameter positioned adjacent each other, and a retainer ring 180 having a groove 182 on an inner surface thereof may be positioned over the respective circular flanges 112, 212 of light body 100 and pivot base 210 to provide a rotatable joint. The electrical slip ring may comprise: a pair of coaxial circular electrical contacts 432, 434 coaxial with the circular flange 112, 212 of one of light body 100 and pivot base 210; and a pair of electrical contacts 222, 232 in the other of light body 100 and pivot base 210, each of the pair of electrical contacts 222, 232 being positioned for contacting a respective one of the pair of coaxial circular electrical contacts 432, 434, whereby at least two electrical conduction paths are provided between light body 100 and light head 210. The coaxial electrically conductive members 224, 234 may comprise: a pair of coaxial electrically conductive members 224, 234 separated by a coaxial insulating member 244, wherein the pair of coaxial electrically conductive members 224, 234 separated by a coaxial insulating member 244 provide the pivotable mount and at least two electrical conduction paths between light body 100 and light source 250. Portable light 10, 10', 10" may further comprise: a clip 500 mounted to a side of light body 100; or at least one magnet 340, 340' mounted to a side of light body 100 for holding light body 100 proximate a metal object; or at least one magnet 340, 340' mounted to a side of light body 100 for holding light body 100 proximate a metal object and a clip 500 mounted to the side of light body 100; or at least one magnet 340, 340' mounted to a side of light body 100 proximate light head 200 for holding light body 100 proximate a metal object; or at least one magnet 340, 340' mounted to a side of light body 100 remote from light head 200 for holding light body 100 proximate a metal object; or a plurality of magnets 340, 340' mounted to a side of light body 100 for holding light body 100 proximate a metal object. The at least one magnet 340, 340' may comprise: one magnet 340, 340' mounted to a side of light body 100 for holding light body 100 proximate a metal object; or one magnet 340, 340' mounted to a side of light body 100 for holding light body 100 proximate a metal object and a clip 500 mounted to the side of light body 100; or one magnet 340, 340' mounted to a side of said light body 100 proximate light head 200 for holding light body 100 proximate a metal object; or one magnet 340, 340' mounted to a side of light body 100 remote from light head 200 for holding light body 100 proximate a metal object; or a plurality of magnets 340, 340' mounted to a side of light body 100 for holding light body 100 proximate a metal object.

A portable light 10, 10', 10" may comprise: a light body 100 having first and second ends and defining an axis 101 between the first and second ends, light body 100 having a track 320 in a direction generally between the first and second ends thereof; a light source 250 on light body 100; and a hanger 330 having an end riding in the track 320 of light body 100 and movable therein, wherein hanger 330 is movable to positions over a range of angles relative to light body 100. Hanger 330 may be movable along track 320 to positions over a range of angles relative to light body 100. Light body 100 may comprise a housing 110 and a hanger housing 310, 310' attached to light body housing 110, wherein hanger housing 310, 310' provides the track 320 in a direction generally between the first and second ends of said light body.

A portable light 10, 10', 10" may comprise: a light body 100 including a housing 110 and a housing member 310, 310' attached thereto; a light head 200 on light body 100; and a plurality of magnets 340, 340' mounted in housing member 310, 310' on a side of light body housing 110 for holding light body 100 proximate a metal object. The plurality of magnets 340, 340' may each have an opening therethrough, and wherein the plurality of magnets 340, 340' and housing member 310, 310' may be attached to light body housing 110 by a respective fastener 348 disposed in the opening of each of the plurality of magnets 340, 340'.

A portable light 10, 10', 10" may comprise: a light body 100 having first and second ends and defining an axis 101 between the first and second ends, light body 100 having a track 320 in a direction generally between the first and second ends thereof; a light head 200 mounted to light body 100; a plurality of magnets 340, 340' mounted to a side of light body 100 for holding light body 100 proximate a metal object; and a hanger 330 having an end riding in the track 320 of light body 100 and movable therein, wherein hanger 330 is movable to positions over a range of angles relative to light body 100. Light body 100 may comprise a housing 110 and a hanger housing 310, 310' attached to light body housing 110, wherein hanger housing 310, 310' provides the track 320 in a direction generally between the first and second ends of light body 100. The light head 100 may be movable relative to light body 100. Light head 200 may include a pivot base 210 rotatably mounted to light body 100 and a light source 250 pivotably mounted to pivot base 210, wherein light source 250 produces light when electrical power is applied thereto; wherein light head 200 is rotatable at least 360° about the light body axis and light source 250 is pivotable about 180° about the pivot base 210 of the light head 200; and first and second electrical conduction paths may be for applying electrical power to light source 250 when a source of electrical power is in the cavity of light body 100. The first and second electrical conduction paths may comprise: a pair of coaxial circular electrical contacts 432, 434 coaxial with one of light body 100 and pivot base 210; and a pair of electrical contacts 222, 232 in the other of light body 100 and pivot base 210, each of the pair of electrical contacts 222, 232 positioned for contacting a respective one of pair of coaxial circular electrical contacts 432, 434; and may further comprise: a pair of coaxial electrically conductive members 224, 234 separated by a coaxial insulating member 244, wherein the pair of coaxial electrically conductive members 224, 234 separated by a coaxial insulating member 244 provide the pivotable mount, and wherein the pair of coaxial electrically conductive members 223, 234 separated by a coaxial insulating member 244 are electrically coupled to the one of the pair of coaxial circular electrical contacts 432, 434 or to the pair of electrical contacts 222, 232 of light head 200 or pivot base 210 to provide the first and second electrical conduction paths between light body 100 and light source 250.

A portable light 10, 10', 10" may comprise: a light body 100 having a circular flange 112; a light head 200 having a circular flange 212 of like diameter to the circular flange 112 of light body 100, 110, wherein the circular flange 212 of light head 200 is disposed adjacent the circular flange 112 of light body 100, 110 and coaxial therewith; a split retainer ring 180 having a groove 182 on an inner surface thereof, wherein split retainer ring 180 is positioned over the adjacent respective circular flanges 112, 212 of light body 100, 110 and light head 200 to provide a rotatable joint, wherein light head 100 is rotatable relative to light body 100, 110; split retainer ring 180 having a recess on each side of the split 181 therein, or having a projection on each side of the split 181 therein, or having a combination of a recess on one side of the split 181 therein and a projection on the other side of the split 181 therein; and a member 310, 310' attachable to light body 100, 110 for engaging the recesses or the projections or the recess and projection of split retainer ring 180 to maintain the split retainer ring 180 closed over the respective circular flanges 112, 212 of light body 100, 110 and light head 200. The member 10 attachable to light body 100, 110 may have spaced apart projections, or spaced apart recesses, or spaced apart projection and a recess, that are complementary to the recesses or the projections or the recess and projection of split retainer ring 180, wherein the recesses and/or projections of member 310, 310' and split retainer ring 180 engage to keep split retainer ring 180 closed. Portable light 10, 10', 10" may further comprise: a pair of coaxial circular electrical contacts 432, 434 coaxial with the circular flange 1112, 212 of one of light body 100, 110 and light head 200; and a pair of electrical contacts 222, 232 in the other of light body 100 and light head 200, each of the pair of electrical contacts 222, 232 positioned for contacting a respective one of the pair of coaxial circular electrical contacts 432, 434, whereby at least two electrical conduction paths 220, 230 are provided between light body 100 and light head 200. Each of the pair of electrical contacts 222,232 may be spaced apart from the axis 101 of light body 100, whereby each of the pair of electrical contacts 222, 232 follows a circular path on a respective one of the pair of coaxial circular electrical contacts 432, 434 as light head 200 rotates relative to light body 100.

A method for making a portable light 10, 10', 10" may comprise: receiving a light body 100, 110 having a circular flange 112 and a light head 200 having a circular flange 212 of like diameter to the circular flange of the light body 100, 110; positioning the circular flange 212 of the light head 200 adjacent the circular flange 112 of the light body 100, 110 and coaxial therewith; positioning a split retainer ring 180 having a groove 182 on an inner surface thereof over the adjacent respective circular flanges 112, 212 of the light body 100, 110 and the light head 200 to provide a rotatable joint, whereby the light head 200 is rotatable relative to the light body 100, 110; wherein the split retainer ring 180 has a recess on each side of the split 181 therein, or has a projection on each side of the split 181 therein, or has a combination of a recess on one side of the split 181 therein and a projection on the other side of the split 181 therein; and attaching a member 310, 310' to the light body 100, 110 in engagement with the recesses or the projections or the recess and projection of the split retainer ring 180, whereby the split retainer ring 180 is maintained closed over the respective circular flanges 112, 212 of the light body 100, 110 and the light head 200. The attaching a member 310, 310' to the light body 100, 110 may include engaging spaced apart projections, or spaced apart recesses, or spaced apart projection and a recess, of the member 310, 310' that are complementary to the recesses or the projections or the recess and projection of the split retainer ring 180, whereby the recesses and/or projections of the member 310, 310' and the split retainer ring 180 engage to keep the split retainer ring 180 closed.

A portable light 10, 10', 10" may comprise: a light body 100 having a cavity for receiving a source of electrical power; a light head 200 including a pivot base 210 rotatably mounted to light body 100 at a first rotatable joint and a light source 250 rotatably mounted to pivot base 210 at a second rotatable joint, wherein light source 250 produces light when electrical power is applied thereto; first and second electrical conduction paths 220, 230 between light body 100 and light head 200 for applying electrical power to light source 250 through the first and second rotatable joints 220, 230 when a source of electrical power is in the cavity of light body 100, the first and second electrical conduction paths 220, 230 comprising: a pair of coaxial circular electrical contacts 432, 434 coaxial with one of light body 100 and pivot base 210; and a pair of electrical contacts 22,232 in the other of light body 100 and pivot base 210, each of the pair of electrical contacts 222, 232 positioned for contacting a respective one of the pair of coaxial circular electrical contacts 432, 434; and further comprising: a pair of coaxial electrically conductive members 224, 234 separated by an insulating member 244 providing a rotatable joint, wherein the pair of coaxial electrically conductive members 232, 234 separated by an insulating member 244 are electrically coupled to the one of the pair of coaxial electrical contacts 432, 434 or the pair of electrical contacts 222, 232; thereby to provide the first and second electrical conduction paths 220, 230 between light body 100 and light source 250. Light head 250 may be rotatable at least 360° about the light body axis 101 and light source 250 may be pivotable at least 180° about the pivot base 250 of the light head 200. The light body 100 may have a track 320 and may further comprise: a hanger 330 having an end 332 riding in the track 330 of light body 100 and movable therein, wherein hanger 330 is movable to positions over a range of angles relative to light body 100. Light body 100 may have a storage recess 350 for receiving hanger 330 and wherein hanger 330 is storable in the storage recess 350. Light body 100 may comprise a light body housing 110 and a hanger housing 310, 310' attached to light body housing 210, wherein hanger housing 310, 310' provides the track 320 for hanger 330. The light body 100 and the pivot base 210 of light head 200 may have respective circular flanges 112, 212 of like diameter positioned adjacent each other, and may further comprise a retainer ring 180 having a groove 182 on an inner surface thereof, wherein retainer ring 180 is positioned over the respective circular flanges 112, 212 of light body 100 and pivot base 210 to provide a rotatable joint. Portable light 10, 10', 10" may further comprise: a clip 500 mounted to a side of light body 100; or at least one magnet 340, 340' mounted to a side of light body 100 for holding light body 100 proximate a metal object; or at least one magnet 340, 340' mounted to a side of light body 100 for holding light body 100 proximate a metal object and a clip 500 mounted to the side of light body 100; or at least one magnet 340, 340' mounted to a side of light body 100 remote from light head 200 for holding light body 100 proximate a metal object; or a plurality of magnets 340, 340' mounted to a side of light body 100 for holding light body 100 proximate a metal object. The light source 250 may include a reflector 260, and: wherein reflector 260 may have a parabolic shape or a squared trapezoidal shape; or wherein reflector 260 may be shaped to provide a flood light beam or may be shaped to provide a spot light beam; or wherein reflector 260 may have a parabolic shape or a squared trapezoidal shape and may be shaped to provide a flood light beam or may be shaped to provide a spot light beam.

A portable light 10, 10', 10" may comprise: a light body 100 having first and second ends and defining a light body axis 101, light body 100 having a cavity for receiving a source of electrical power; a light head 200 including a pivot base 210 rotatably mounted to light body 100 and a light source 250 pivotably mounted to pivot base 210, wherein light source 250 produces light when electrical power is applied thereto; wherein light head 200 is rotatable at least 360° about the light body axis 101 and light source 250 is pivotable about 180° about the pivot base 210 of the light head 200; and first and second electrical conduction paths 220, 230 for applying electrical power to light source 250 when a source of electrical power is in the cavity of light body 100, comprising: a pair of coaxial circular electrical contacts 432, 434 coaxial with one of light body 100 and pivot base 210; and a pair of electrical contacts 222, 232 in the other of light body 100 and pivot base 210, each of the pair of electrical contacts 222, 232 positioned for contacting a respective one of the pair of coaxial circular electrical contacts 432, 434; and further comprising: a pair of coaxial electrically conductive members 224, 234 separated by a coaxial insulating member 244, wherein the pair of coaxial electrically conductive members 224, 234 separated by a coaxial insulating member 244 provide the pivotable mount, and wherein the pair of coaxial electrically conductive members 224, 234 separated by a coaxial insulating member 244 are electrically coupled to the one of the pair of coaxial circular electrical contacts 432, 434 or to the pair of electrical contacts 222, 232 of light head 200 or pivot base 210 to provide the first and second electrical conduction paths 220, 230 between light body 100 and light source 250. The light body 100 may have a track 320 and may further comprise: a hanger 330 having an end 332 riding in the track 330 of light body 100 and movable therein, wherein hanger 330 is movable to positions over a range of angles relative to light body 100. Light body 100 may have a storage recess 350 for receiving hanger 330 and wherein hanger 330 is storable in the storage recess 350. Light body 100 may comprise a light body housing 110 and a hanger housing 310, 310' attached to light body housing 210, wherein hanger housing 310, 310' provides the track 320 for hanger 330. The light body 100 and the pivot base 210 of light head 200 may have respective circular flanges 112, 212 of like diameter positioned adjacent each other, and may further comprise a retainer ring 180 having a groove 182 on an inner surface thereof, wherein retainer ring 180 is positioned over the respective circular flanges 112, 212 of light body 100 and pivot base 210 to provide a rotatable joint. Portable light 10, 10', 10" may further comprise: a clip 500 mounted to a side of light body 100; or at least one magnet 340, 340' mounted to a side of light body 100 for holding light body 100 proximate a metal object; or at least one magnet 340, 340' mounted to a side of light body 100 for holding light body 100 proximate a metal object and a clip 500 mounted to the side of light body 100; or at least one magnet 340, 340' mounted to a side of light body 100 remote from light head 200 for holding light body 100 proximate a metal object; or a plurality of magnets 340, 340' mounted to a side of light body 100 for holding light body 100 proximate a metal object. The light source 250 may include a reflector 260, and: wherein reflector 260 may have a parabolic shape or a squared trapezoidal shape; or wherein reflector 260 may be shaped to provide a flood light beam or may be shaped to provide a spot light beam; or wherein reflector 260 may have a parabolic shape or a squared trapezoidal shape and may be shaped to provide a flood light beam or may be shaped to provide a spot light beam.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding oft measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electrochemical device comprising one or more electro-chemical cells, and so a battery may include a single cell or plural cells, whether as individual units or as a packaged unit.

Further, what is stated as being "optimum" or "deemed optimum" may or not be a true optimum condition, but is the condition deemed to be desirable or acceptably "optimum" by virtue of its being selected in accordance with the decision rules and/or criteria defined by the applicable controlling function, e.g., the current flowing in LEDs 274 may be "optimized" for different parameters, e.g., light output, efficiency, operating temperature or another parameter.

While the present invention has been described in terms of the foregoing example embodiments, variations within the scope and spirit of the present invention as defined by the claims following will be apparent to those skilled in the art. For example, the hanger 330 may be of any suitable shape, e.g., hanger 330 may have a hook shape or an eye shape or a tee shape or a nail-head shape, or any other shape or combination of shapes by which the light 10 may be hung from or attached to an object.

Alternatively, the diameter of track 320 may be made to alternate between a slightly smaller diameter and a slightly larger diameter along the length of track 320 so as to proved a serrated track that tends to define particular positions of larger diameter along the length of track 320 where hanger 330 may be placed and will tend to remain.

While certain elements may be shown as having a projection that fits into a complementary recess of another element, such recesses and projections may be interchanged between elements so long as the complementary mating relationship is maintained. For example, circuit boards 450 and 460 could have their respective interconnecting openings and tabs exchanged, as could the be the projection 116 and clip 136 of latch 150 and/or the prongs 184 of retainer 180 and the recesses 304 of housing 310, 310'.

While four magnets are illustrated for holding portable light 10 to a metallic object, a greater or lesser number of magnets may be employed. In a preferred embodiment, a relatively larger single magnet may be employed so as to render light 10 more firmly attachable to an irregular or nonplanar surface. In another preferable embodiment, at least three magnets are employed because they define a plane which is thought to improve the stability of light 10 relative to the object to which it is magnetically attached. Further, while light 10 is attached to an object by its magnets 340, hanger 330 may be employed to support another object, e.g., a tool, from light 10 whereby the magnets 340 and hanger 330 of light 10 serve dual functions for supporting light 10 and for light 10 supporting another object.

Fasteners may be employed for retaining various elements of light 10 in desired locations. Such fasteners may include screws, bolts, pins, drive screws, drive pins, rivets, nails, adhesives, sonic or heat welding, peened pins or rivets, or any other suitable fastener arrangement.

Any U.S. Patent and/or U.S. Patent Application identified herein is hereby incorporated herein by reference in its entirety, for any purpose and for all purposes irrespective of how it may be referred to herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body having first and second ends and defining an axis between the first and second ends, said light body having an elongated track in a direction generally between the first and second ends thereof;

a light head having a pivot base mounted at the first end of said light body and rotatable about the light body axis, said light head having a light source pivotably mounted to the pivot base thereof and pivotable at least about 180° relative to the pivot base; and a hanger having an end riding in the elongated track of said light body and movable along the length of the elongated track, wherein the end of said hanger is not clamped at one location and wherein said hanger is movable along and rotatable 360° and pivotable in the elongated track to a range of positions relative to said light body.

2. The portable light of claim 1 wherein said light body and the pivot base of said light head have respective circular flanges of like diameter positioned adjacent each other, further comprising a retainer ring having a groove on an inner surface thereof, wherein said retainer ring is positioned over the respective circular flanges of said light body and said pivot base to provide a rotatable joint.

3. The portable light of claim 2 further comprising:

a pair of coaxial circular electrical contacts coaxial with the circular flange of one of said light body and said pivot base; and a pair of electrical contacts in the other of said light body and said pivot base, each of said pair of electrical contacts positioned for contacting a respective one of said pair of coaxial circular electrical contacts, whereby at least two electrical conduction paths are provided between said light body and said light head.

4. The portable light of claim 2 wherein said retainer ring is a split retainer ring having a recess on each side of the split therein, or having a projection on each side of the split therein, or having a combination of a recess on one side of the split therein and a projection on the other side of the split therein, said light further comprising:

a member attachable to said light body, said member having spaced apart projections, or spaced apart recesses, or spaced apart projection and a recess, in locations complementary to the recesses or the projections or the recess and projection of said split retainer ring, wherein the recesses and/or projections of said member and said split retainer ring engage to keep said split retainer ring closed.

5. The portable light of claim 1 further comprising: a pair of coaxial electrically conductive members separated by a coaxial insulating member, wherein said pair of coaxial electrically conductive members separated by a coaxial insulating member provide the pivotable mount and at least two electrical conduction paths between said light body and said light head.

6. The portable light of claim 1 wherein:

said light head is rotatable at least 360° about the light body axis, or said light source is pivotable about 180° about the base; or said light head is rotatable at least 360° about the light body axis and said light source is pivotable about 180° about the base of the light head.

7. The portable light of claim 1 wherein:

said hanger is movable and/or rotatable in the track to a storage position adjacent said light body; or said hanger is movable and/or rotatable in the track to a range of positions relative to said light body and to a storage position adjacent said light body.

8. The portable light of claim 1 wherein said light source includes a reflector, and:

wherein said reflector has a parabolic shape or a squared trapezoidal shape; or wherein said reflector is shaped to provide a flood light beam or is shaped to provide a spot light beam; or wherein said reflector has a parabolic shape or a squared trapezoidal shape and said reflector is shaped to provide a flood light beam or is shaped to provide a spot light beam.

9. The portable light of claim 1 further comprising:

a clip mounted to a side of said light body; or at least one magnet mounted to a side of said light body for holding said light body proximate a metal object; or at least one magnet mounted to a side of said light body for holding said light body proximate a metal object and a clip mounted to the side of said light body;

at least one magnet mounted to a side of said light body proximate said light head for holding said light body proximate a metal object; or at least one magnet mounted to a side of said light body remote from said light head for holding said light body proximate a metal object; or a plurality of magnets mounted to a side of said light body for holding said light body proximate a metal object.

10. The portable light of claim 1 wherein said light body has a cavity for receiving a battery, further comprising:

a battery in the cavity of said light body; or a rechargeable battery in the cavity of said light body.

11. The portable light of claim 1 wherein said light body has a storage recess for receiving said hanger and wherein said hanger is storable in the storage recess.

12. The portable light of claim 1 wherein said hanger has a hook shape, an eye shape, a tee shape, a loop shape, a nail-head shape, or a combination thereof.

13. A portable light comprising:

a light body having first and second ends and defining an axis between the first and second ends, at least one magnet mounted to said light body, wherein said at least one magnet has magnetic strength sufficient to magnetically support said portable light;

a light head including a pivot base rotatably mounted at the first end of said light body and rotatable about the light body axis, wherein the rotatable mounting of said light head and said light body includes an electrical slip ring providing electrical connections through the rotatable mounting of said light head and said light body;

said light head including a light source rotatably mounted to the pivot base thereof and rotatable at least about 180° relative to the pivot base, wherein the rotatable mounting of said light source and said pivot base includes coaxial cylindrical electrically conductive members with a coaxial cylindrical insulating member disposed between and coaxial with the cylindrical electrically conductive members, whereby one of the cylindrical electrically conductive members is outside and surrounding the cylindrical insulating member and another of the cylindrical electrically conductive members is inside the cylindrical insulating member, the cylindrical electrically conductive members providing electrical connections through the rotatable mounting of said light source and said pivot base.

14. The portable light of claim 13 wherein:

said light body has a track and further comprises a hanger having an end riding in the track of said light body and movable therein, wherein said hanger is movable to positions over a range of angles relative to said light body; or said light body further comprises a pivotable clip pivotably mounted to said light body, wherein said pivotable clip has a clipping end biased to bear against said light body.

15. The portable light of claim 14 wherein said light body comprises a light body housing and a hanger housing attached to said light body housing, wherein said hanger housing provides the track for said hanger or provides a mount for said pivotable clip or provides both.

16. The portable light of claim 13 wherein said light body and the pivot base of said light head have respective circular flanges of like diameter positioned adjacent each other, further comprising a retainer ring having a groove on an inner surface thereof, wherein said retainer ring is positioned over the respective circular flanges of said light body and said pivot base to provide a rotatable joint.

17. The portable light of claim 16 wherein the electrical slip ring comprises:

a pair of coaxial circular electrical contacts coaxial with the circular flange of one of said light body and said pivot base; and a pair of electrical contacts in the other of said light body and said pivot base, each of said pair of electrical contacts positioned for contacting a respective one of said pair of coaxial circular electrical contacts, whereby at least two electrical conduction paths are provided between said light body and said light head.

18. The portable light of claim 13 wherein said pair of coaxial electrically conductive members separated by a coaxial insulating member provide the pivotable mount and at least two electrical conduction paths between said light body and said light source.

19. The portable light of claim 13 wherein said at least one magnet comprises:

one magnet mounted to a side of said light body for holding said light body proximate a metal object; or one magnet mounted to a side of said light body for holding said light body proximate a metal object and a clip mounted to the side of said light body; or one magnet mounted to a side of said light body proximate said light head for holding said light body proximate a metal object; or one magnet mounted to a side of said light body remote from said light head for holding said light body proximate a metal object; or a plurality of magnets mounted to a side of said light body for holding said light body proximate a metal object.

20. A portable light comprising:

a light body having first and second ends and defining a light body axis, said light body having a cavity for receiving a source of electrical power;

a light head including a pivot base rotatably mounted to said light body and a light source pivotably mounted to said pivot base, wherein said light source produces light when electrical power is applied thereto;

wherein said light head is rotatable at least 360° about the light body axis and said light source is pivotable at least about 180° about the pivot base of the light head; and first and second electrical conduction paths for applying electrical power to said light source when a source of electrical power is in the cavity of said light body, comprising:

a pair of coaxial circular electrical contacts coaxial with one of said light body and said pivot base; and a pair of electrical contacts in the other of said light body and said pivot base, each of said pair of electrical contacts positioned for contacting a respective one of said pair of coaxial circular electrical contacts; and further comprising:

a pair of coaxial cylindrical electrically conductive members separated by a coaxial cylindrical insulating member disposed between and coaxial with the cylindrical electrically conductive members, whereby one of the cylindrical electrically conductive members is outside and surrounding the cylindrical insulating member and another of the cylindrical electrically conductive members is inside the cylindrical insulating member, wherein said pair of coaxial cylindrical electrically conductive members separated by a coaxial cylindrical insulating member provide the pivotable mount, and wherein said pair of coaxial cylindrical electrically conductive members separated by a coaxial cylindrical insulating member are electrically coupled to the one of said pair of coaxial circular electrical contacts or to said pair of electrical contacts of said light head or said pivot base to provide the first and second electrical conduction paths between said light body and said light source.

21. The portable light of claim 20 wherein said light body has a track and further comprises:

a hanger having an end riding in the track of said light body and movable therein, wherein said hanger is movable to positions over a range of angles relative to said light body.

22. The portable light of claim 21 wherein said light body has a storage recess for receiving said hanger and wherein said hanger is storable in the storage recess.

23. The portable light of claim 21 wherein said light body comprises a light body housing and a hanger housing attached to said light body housing, wherein said hanger housing provides the track for said hanger.

24. The portable light of claim 20 wherein said light body and the pivot base of said light head have respective circular flanges of like diameter positioned adjacent each other, further comprising a retainer ring having a groove on an inner surface thereof, wherein said retainer ring is positioned over the respective circular flanges of said light body and said pivot base to provide a rotatable joint.

25. The portable light of claim 20 further comprising:

a clip mounted to a side of said light body; or at least one magnet mounted to a side of said light body for holding said light body proximate a metal object; or at least one magnet mounted to a side of said light body for holding said light body proximate a metal object and a clip mounted to the side of said light body;

at least one magnet mounted to a side of said light body proximate said light head for holding said light body proximate a metal object; or at least one magnet mounted to a side of said light body remote from said light head for holding said light body proximate a metal object; or a plurality of magnets mounted to a side of said light body for holding said light body proximate a metal object.

26. The portable light of claim 21 wherein said light source includes a reflector, and:

wherein said reflector has a parabolic shape or a squared trapezoidal shape; or wherein said reflector is shaped to provide a flood light beam or is shaped to provide a spot light beam; or wherein said reflector has a parabolic shape or a squared trapezoidal shape and is shaped to provide a flood light beam or is shaped to provide a spot light beam.

27. A portable light comprising:

a light body having first and second ends and defining an axis between the first and second ends, a light head including a pivot base rotatably mounted at the first end of said light body and rotatable about the light body axis, wherein the rotatable mounting of said light head and said light body includes an electrical slip ring providing electrical connections through the rotatable mounting of said light head and said light body;

said light head including a light source pivotably mounted to the pivot base thereof and pivotable at least about 180° relative to the pivot base, wherein the pivotable mounting of said light source and said pivot base includes coaxial cylindrical electrically conductive members providing two electrical connections through one pivotable mounting joint of said light source and said pivot base, the pivotable mounting joint having one of the cylindrical electrically conductive members disposed outside and surrounding a cylindrical insulating member and another of the cylindrical electrically conductive members disposed inside the cylindrical insulating member.

28. The portable light of claim 27 wherein said light body has a track and further comprises:

a hanger having an end riding in the track of said light body and movable therein, wherein said hanger is movable to positions over a range of angles relative to said light body.

29. The portable light of claim 28 wherein said light body comprises a light body housing and a hanger housing attached to said light body housing, wherein said hanger housing provides the track for said hanger.

30. The portable light of claim 27 wherein said light body and the pivot base of said light head have respective circular flanges of like diameter positioned adjacent each other, further comprising a retainer ring having a groove on an inner surface thereof, wherein said retainer ring is positioned over the respective circular flanges of said light body and said pivot base to provide a rotatable joint.

31. The portable light of claim 30 wherein the electrical slip ring comprises:

a pair of coaxial circular electrical contacts coaxial with the circular flange of one of said light body and said pivot base; and a pair of electrical contacts in the other of said light body and said pivot base, each of said pair of electrical contacts positioned for contacting a respective one of said pair of coaxial circular electrical contacts, whereby at least two electrical conduction paths are provided between said light body and said light head.

32. The portable light of claim 27 further comprising:

a clip mounted to a side of said light body; or at least one magnet mounted to a side of said light body for holding said light body proximate a metal object; or at least one magnet mounted to a side of said light body for holding said light body proximate a metal object and a clip mounted to the side of said light body; or at least one magnet mounted to a side of said light body proximate said light head for holding said light body proximate a metal object; or at least one magnet mounted to a side of said light body remote from said light head for holding said light body proximate a metal object; or a plurality of magnets mounted to a side of said light body for holding said light body proximate a metal object.

* * * * *